US011072927B1

(12) United States Patent
Frein

(10) Patent No.: US 11,072,927 B1
(45) Date of Patent: Jul. 27, 2021

(54) FRAMING ASSEMBLY

(71) Applicant: Thomas G. Frein, Midway, AR (US)

(72) Inventor: Thomas G. Frein, Midway, AR (US)

( * ) Notice: Subject to any disclaimer, the term of this patent is extended or adjusted under 35 U.S.C. 154(b) by 0 days.

(21) Appl. No.: 17/019,275

(22) Filed: Sep. 13, 2020

Related U.S. Application Data

(60) Provisional application No. 62/993,844, filed on Mar. 24, 2020, provisional application No. 62/899,949, filed on Sep. 13, 2019.

(51) Int. Cl.

| | |
|---|---|
| ***E04B 5/00*** | (2006.01) |
| ***E04C 2/24*** | (2006.01) |
| ***E04C 2/38*** | (2006.01) |
| *E04C 2/00* | (2006.01) |

(52) U.S. Cl.
CPC ..... *E04C 2/243* (2013.01); *E04C 2/38* (2013.01); *E04C 2002/007* (2013.01); *E04C 2002/008* (2013.01)

(58) Field of Classification Search
None
See application file for complete search history.

(56) References Cited

U.S. PATENT DOCUMENTS 2,362,162 A * 11/1944 Sheldon ..... E04B 1/6158 52/274
3,462,897 A * 8/1969 Weinrott ..... E04B 1/14 52/169.14
4,114,333 A * 9/1978 Jones ..... E04B 2/7411 52/265
4,320,604 A * 3/1982 O'Hanlon ..... E04B 1/80 52/169.11
4,797,020 A * 1/1989 Winston ..... E04B 1/2604 403/230
5,207,042 A * 5/1993 Molinar ..... E04B 1/0007 52/293.1
5,577,356 A * 11/1996 Hubbard ..... E04B 2/702 52/233
5,600,924 A * 2/1997 Forsberg ..... E04B 1/24 52/276
5,950,389 A 9/1999 Porter
6,012,626 A 1/2000 Irvin
6,035,583 A * 3/2000 Papke ..... E04B 1/12 52/268

(Continued)

FOREIGN PATENT DOCUMENTS

EP 2186961 5/2010

*Primary Examiner* — Basil S Katcheves
(74) *Attorney, Agent, or Firm* — Rashauna Norment

(57) ABSTRACT

A framing assembly has a plurality of modified splines, a plurality of modified panels, and at least one surface attachment member for constructing the frame of a building structure having interior exposed beams. The plurality of splines are rafter splines, extended rafter splines, or wall splines. Each spline has a support member and a pair of flanges abutting a lower portion of the support member. At least one surface attachment member is attachable to a lower portion of each spline as a decorative feature. The panels are modified structural insulated panels (SIPs) coupled to at least one of the splines to form a wall section, a ceiling section, or a roof section. Once assembled, the SIPs outer skin forms a continuous backing for the remaining exterior (or outer) wall or ceiling treatment. The splines not only support the modified SIPs, but also support the roof.

11 Claims, 27 Drawing Sheets

(56) References Cited

U.S. PATENT DOCUMENTS

| | | | | |
|---|---|---|---|---|
| 6,272,796 | B1 * | 8/2001 | Metzler | E04C 3/46 52/93.1 |
| 6,481,172 | B1 | 11/2002 | Porter | |
| 7,739,841 | B1 * | 6/2010 | Puckett | E04C 3/40 52/93.1 |
| 8,689,511 | B2 | 4/2014 | Fleming, III | |
| 8,733,033 | B2 * | 5/2014 | Schwartau | E02D 27/02 52/169.11 |
| 9,702,147 | B2 * | 7/2017 | Babson | E04B 5/02 |
| 10,024,057 | B2 | 7/2018 | Gibson | |
| 2005/0066587 | A1 * | 3/2005 | Brisson | E04C 2/288 52/79.1 |
| 2007/0131308 | A1 | 6/2007 | Martin | |
| 2009/0205277 | A1 * | 8/2009 | Gibson | E04C 2/296 52/309.9 |
| 2009/0293395 | A1 | 12/2009 | Porter | |
| 2013/0055669 | A1 * | 3/2013 | Olszewski | B32B 15/046 52/283 |
| 2017/0058516 | A1 | 3/2017 | Liberman et al. | |

* cited by examiner

FRAMING ASSEMBLY

CROSS-REFERENCE TO RELATED APPLICATIONS

This utility patent application claims the benefit of and priority to U.S. Provisional Patent Application No. 62/899,949, filed on Sep. 13, 2019, and to U.S. Provisional Patent Application No. 62/993,844, filed on Mar. 24, 2020, each of which are incorporated herein by reference.

FEDERALLY SPONSORED RESEARCH AND DEVELOPMENT

Not applicable.

BACKGROUND OF THE INVENTION

1. Field of the Invention

The present invention generally relates to a framing assembly for constructing at least part of a frame of a building structure. More particularly, the invention is a framing assembly having a plurality of rafter splines, a plurality of extended rafter splines, a plurality of panels, and at least one surface attachment member, with each assembled into a building structure resembling a timber frame building structure.

2. Description of Arguably Related Art Including Information Disclosed for 37 CFR 1.97 and 1.98

Conventional framing methods and framing assemblies are used for constructing a building including, but are not limited to, stick framing and timber framing. With timber framing, heavy timber beams or post and beam framing alternatives form the building structure. Timber frame buildings may be generally assembled on the ground, then raised into position and secured. Wall studs or vertical elements may generally extend the full height of the timber frame structure. Rafter beams may generally extend at least part of the length of the timber frame structure to form the roof.

Structural insulated panels (SIPs) are often used with timber framing, leaving the entire frame visible. Depending on the materials used for the wall studs and roof beams, raising the frame may require using cranes to lift the wall sections and roof sections. Examples of building structures are houses and other residential structure; however, other building structures are contemplated. Some interior building décor features have exposed ceiling beams and/or exposed upstanding wall columns. Depending on the building construction, the exposed beams are either part of the framing itself or are added later in the construction process. Leaving exposed framing is a distinct feature of a timber frame building.

The ceiling panels and wall panels may be either sheetrock, plywood, or SIPs. SIPs are preferred with timber frame buildings. SIPS generally have two layers (or skins) sandwiching a recessed core. The core may be a foam core. The two SIP layers may be oriented strand board (OSB), sheet metal, plywood, or any other material suitable for the purpose. The SIPs are coupled together with lumber studs, rafters, or splines, then secured with nail or screw fasteners, and connected to the floor with a sill plate. The structure of these splines, lumber studs, or lumber beams remain deficient for the desired combination of supporting the SIPs, bearing the wall load and the roof load, and creating an exterior protrusion resembling an exposed beam or an exposed column. See U.S. Pat. No. 5,950,389 (Porter), U.S. Patent Application Publication No. 2007/01311308 (Martin), and U.S. Patent Application Publication No. 2017/0058516 (Liberman et al.).

Problems with conventional timber frame structures or exposed beam structures using timber include, but are not limited to, lumber shrinkage, warpage, and checking. Other problems include the increased cost for materials and labor, and the need for cranes to assemble the building. Problems with using SIPs include lack of exposed beams without compromising the strength of the SIPs.

None of the identified patent references disclose, teach, or suggest the combination of components and structural arrangement of the claimed invention.

A need exists for a framing assembly having a plurality of a plurality of rafter splines and a plurality of extended rafter splines, each preferably made from manufactured or engineered wood products, a plurality of modified structural insulated panels, and at least one surface attachment member when constructing a building to create the appearance of exposed beams without using heavy timber beams.

A need exists for a framing assembly used to construct a timber frame-style building without the expense and cost of using heavy construction equipment, namely, a crane.

A need exists for a framing assembly that uses a configured structural composite lumber and dimensional lumber, along with modified structural insulated panels, to construct a dimensionally stable, strong, and environmentally friendly building having the appearance of exposed beams.

SUMMARY OF THE INVENTION

Due to the described disadvantages inherent in the known types of framing methods for constructing a timber frame building structure or a structure having exposed beams, the present invention provides a new and improved a framing assembly for constructing and framing a building structure having exposed beams, wherein the framing assembly comprises (includes or has) a plurality of rafter splines, a plurality of extended rafter splines, a plurality of panels, and at least one surface attachment member that are used to construct the frame of a building structure to have exposed interior beams. The framing assembly may further include a plurality of wall splines, which once selectively installed between two of the plurality of panels, forms an exposed upstanding column. One or more of the wall splines and rafter splines may be used as an alternative to conventional wall studs or conventional roof rafters when a respective exposed column an exposed rafter beam or an exposed column is desired. When the modified wall spline or the modified rafter spline is not used between two particular structural insulated panels (SIPs), conventional SIPs or a SIP having at least one conventional side may be used with a conventional wall stud or rafter beam.

Each of the spline types preferably comprises manufactured wood products rather than heavy lumber. Each spline is a support member. Each spline may further have a pair of flanges that abut against and sandwich a lower portion of the lateral sides of the support member to form a T-shaped wall column or a T-shaped rafter beam. The plurality of panels forms wall panel sections, ceiling panel sections, exterior roof panels, and exterior wall panels. These panels are preferably modified SIPs. The splines are selectively installed with modified SIPs to couple the modified SIPs together, with a lower portion of each spline protruding outwardly from the joined SIPs as an exposed beam or an exposed column.

The overall frame may be built at the construction site or pre-built in sections offsite then delivered to the construction site for final assembly. The top of each spline flange is essentially a ledge upon which the inner layer (or skin) of the modified SIP rests. Each conventional SIP having an outer layer (or skin), a recessed core, and an inner layer (or skin) is modified to accommodate the spline alternative. The user may selectively use the splines between each coupled modified SIP, or may alternate with using conventional splines and conventional SIPs. The surface attachment members are surface materials that may be selectively attached or applied to a lower portion of each spline as a decorative feature of wood beams or painted beams.

In one embodiment, A framing assembly for constructing the frame of a building structure, the framing assembly comprising (including or having)

(a) a plurality of rafter splines, each of the plurality of rafter splines comprising a support member having a lower portion and an upper portion, and a pair of flanges, with the support member having a depth or height more than a depth or height of each of the pair of flanges, and with each of the pair of flanges abutting and being affixed to the lower portion of the support member forming a lower portion of the rafter spline and with the upper portion of the support member forming the upper portion of the rafter spline; and (b) a plurality of panels, each of the plurality of panels having two opposing sides, with at least one of the two sides having an overhang;

(c) wherein at least one of the plurality of rafter splines is sandwiched between one of the two sides of two of the respective panels, with at least a portion of the upper portion of the rafter spline positioned underneath each panel overhang, and with the assembly of each of the plurality of rafter splines and the plurality of panels selectively forming ceiling sections or roof sections of the building structure; and wherein the upper portion of each rafter spline supports the overhang of two of the plurality of panels, with the lower portion of each rafter spline forming an exposed beam.

The framing assembly not only uses splines to join the modified SIPs together, but also supports the modified SIPs and the roof framework. The splines are mounted between the connected modified SIPs, with the lower, distal portions of the splines extending beyond the SIPs, forming exposed beams or exposed upstanding columns. The splines also provide additional structural strength to the modified SIP outer panels, allowing these panels to be used in longer intervals without using additional support elements, such as braces.

It is an object of the invention to provide a framing assembly having a plurality of rafter splines and a plurality of extended rafter splines, each made from manufactured or engineered wood products, a plurality of structural insulated panels, and at least one surface attachment member when constructing a building to create the appearance of exposed beams without using heavy timber beams.

It is an object of the invention to provide a framing assembly used to construct a timber frame-style building without the expense and cost of using heavy construction equipment, namely, a crane.

It is yet another object of the invention to provide a framing assembly that uses a configured structural composite lumber and dimensional lumber, along with structural insulated panels, to construct a dimensionally stable, strong, and environmentally friendly building having the appearance of exposed beams.

These and other aspects, objects, embodiments, and advantages of the invention will become apparent from the accompanying drawing figures and the following detailed description of the preferred embodiments of the invention.

BRIEF DESCRIPTION OF THE SEVERAL VIEWS OF THE DRAWING

The invention may be more readily described by reference to the accompanying drawing figures and the following description of the drawing figures. The reference numbers apply to each embodiment of the invention. In the drawing.

DETAILED DESCRIPTION OF THE INVENTION

Figure 1:
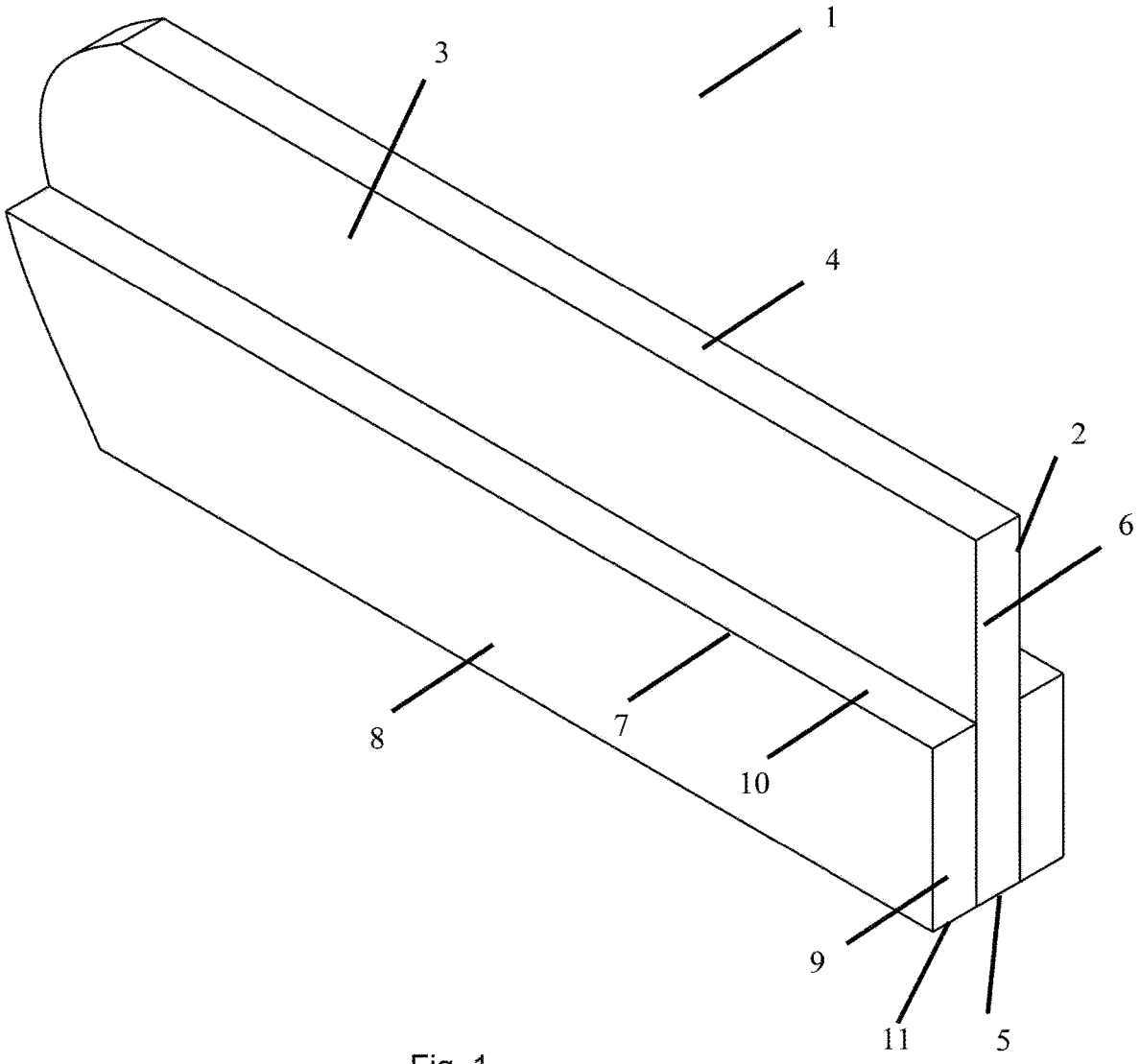
FIG. 1 is a perspective view of a rafter spline or a wall spline, showing part of a framing assembly.

The present invention, preferred embodiments of the invention, and the accompanying drawing figures as described herein should not be construed as limited to the illustrated drawing. Rather, the illustrated embodiment(s)

are detailed to provide a thorough disclosure suitable to convey the scope of the invention to those skilled in the art. For the sake of simplicity, the conjunctive "and" may also be taken to include the disjunctive "or" and vice versa, whenever necessary to give the claims of this patent application the broadest interpretation and construction possible.

Referring more particularly to the drawing by characters of reference, the figures depict a preferred embodiment of the invention. More particularly, the invention is a framing assembly for constructing the frame of a building structure having at least one exposed beam, the framing assembly comprising:

a. a plurality of rafter splines, each of the plurality of rafter splines comprising a support member having a lower portion and an upper portion, and a pair of flanges, with the support member having a depth or height more than a depth or height of each of the pair of flanges, and with each of the pair of flanges abutting and being affixed to the lower portion of the support member a lower portion of the rafter spline and with the upper portion of the support member forming the upper portion of the rafter spline;

b. a plurality of extended rafter splines, each of the plurality of extended rafter splines comprising an extended rafter support member and a pair of flanges,
   i. the extended rafter support member having a lower portion, an upper portion, a first end separated from a second end by a longitudinal body, with the longitudinal body of the extended rafter support member having a length longer than a length of each of a pair of flanges and extending beyond a roof of the building structure as a rafter tail to form part of an eave; and
   ii. the pair of rafter flanges, with the extended rafter support member having a depth or height more than a depth or height of each of the pair of flanges, with each of the pair of flanges abutting and flanking the lower portion of the extended rafter support member forming a lower portion of the extended rafter spline, and with the upper portion of the extended rafter support member forming an upper portion of the extended rafter spline;

c. a plurality of structural insulated panels, each structural insulated panel comprising an outer skin having a top, a bottom, and at least one side; a core within the structural insulated panel, the core having a top, a bottom, an end and at least one side; and an inner skin having a top, a bottom, an end, and at least one side, with the outer skin, the core, and the inner skin mounted together as a layer of the structural insulated panel further, with the structural insulated panel further comprising at least one side of each of the outer skin, the core, and the inner skin, and with at least one side of the top of the outer skin forming an overhang over at least one recessed side of the core and the inner skin;

d. wherein at least one the plurality of rafter splines or at least one of the plurality of extended rafter splines is coupled to the at least one panel side of the plurality of structural insulated panels by abutting a portion of the top of the respective rafter spline support member or extended rafter spline support member against an underside of the structural insulated panel outer skin overhang, by abutting the upper portion of a lateral side of the respective rafter spline support member or extended rafter spline support member against both the end of the recessed core and the inner skin of the structural insulated panel, and by abutting an outer-side of the inner skin to the top of one of the respective rafter spline flanges or extended rafter spline flanges, repeating the assembly with another structural insulated panel to the opposing side of the rafter spline or the extended rafter spline.

Figure 20:
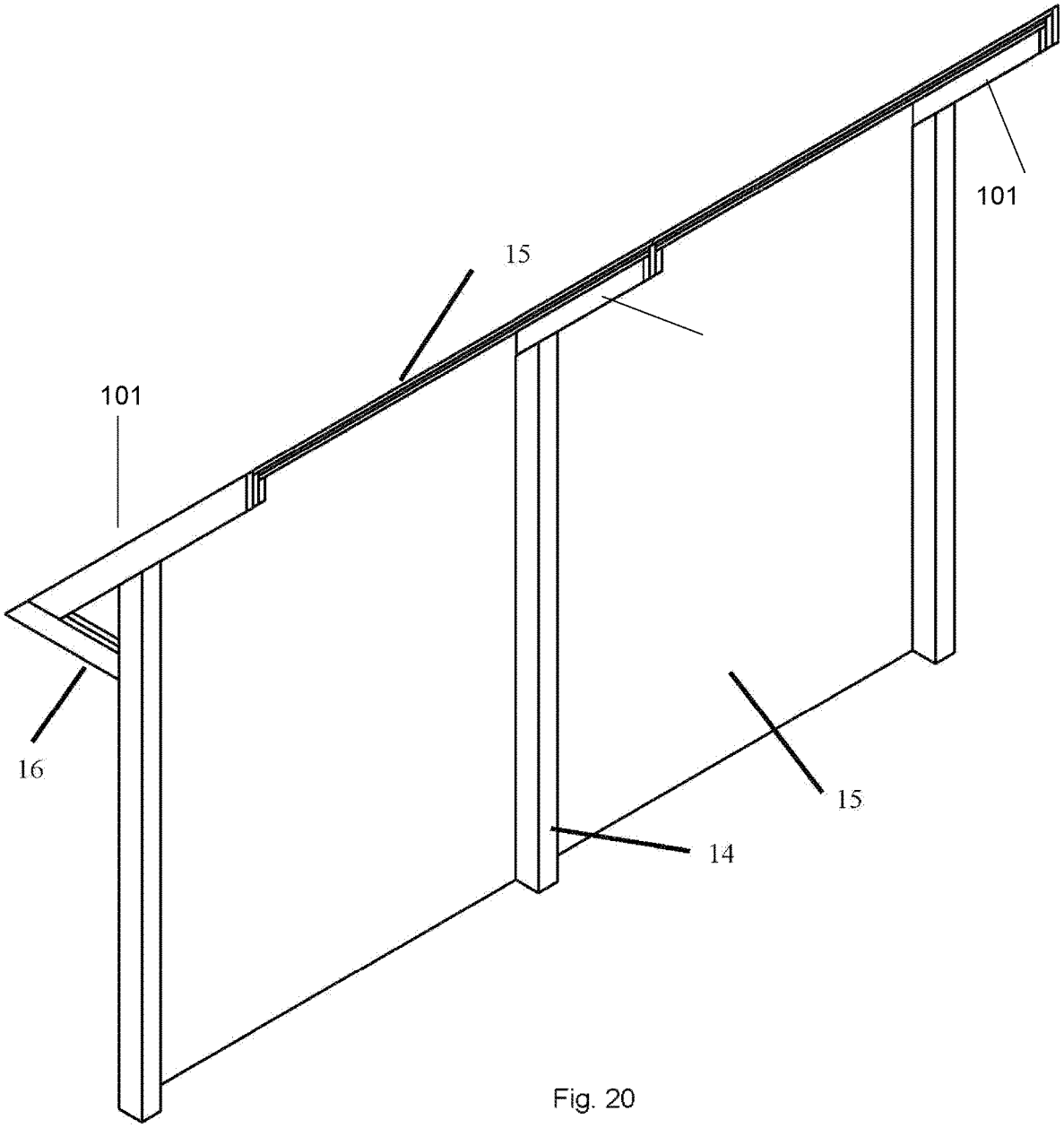
FIG. 20 is a perspective view of another embodiment of FIG. 15 thereof, showing a plurality of surface attachment members coupled to a plurality of wall splines.
Figure 21:
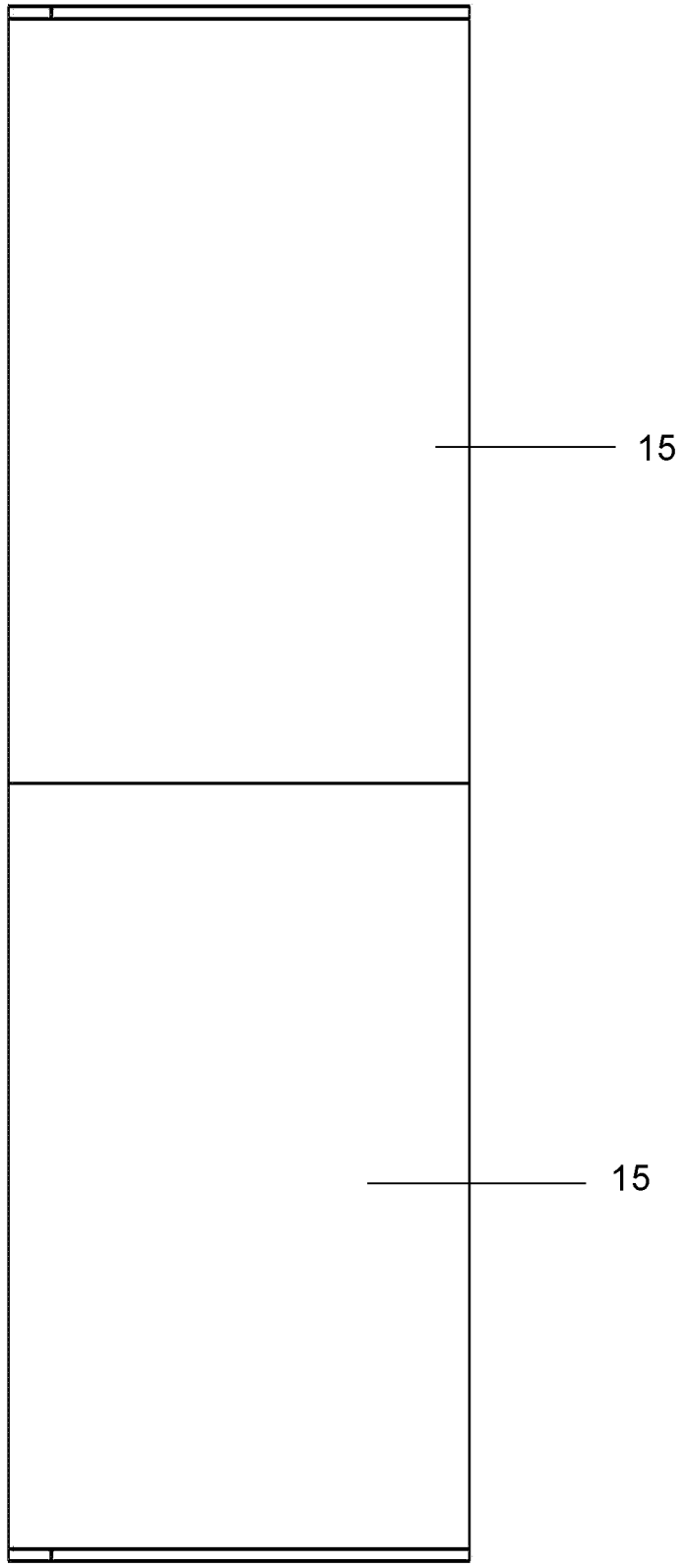
FIG. 21 is a top plan view of FIG. 20 thereof.
Figure 22:
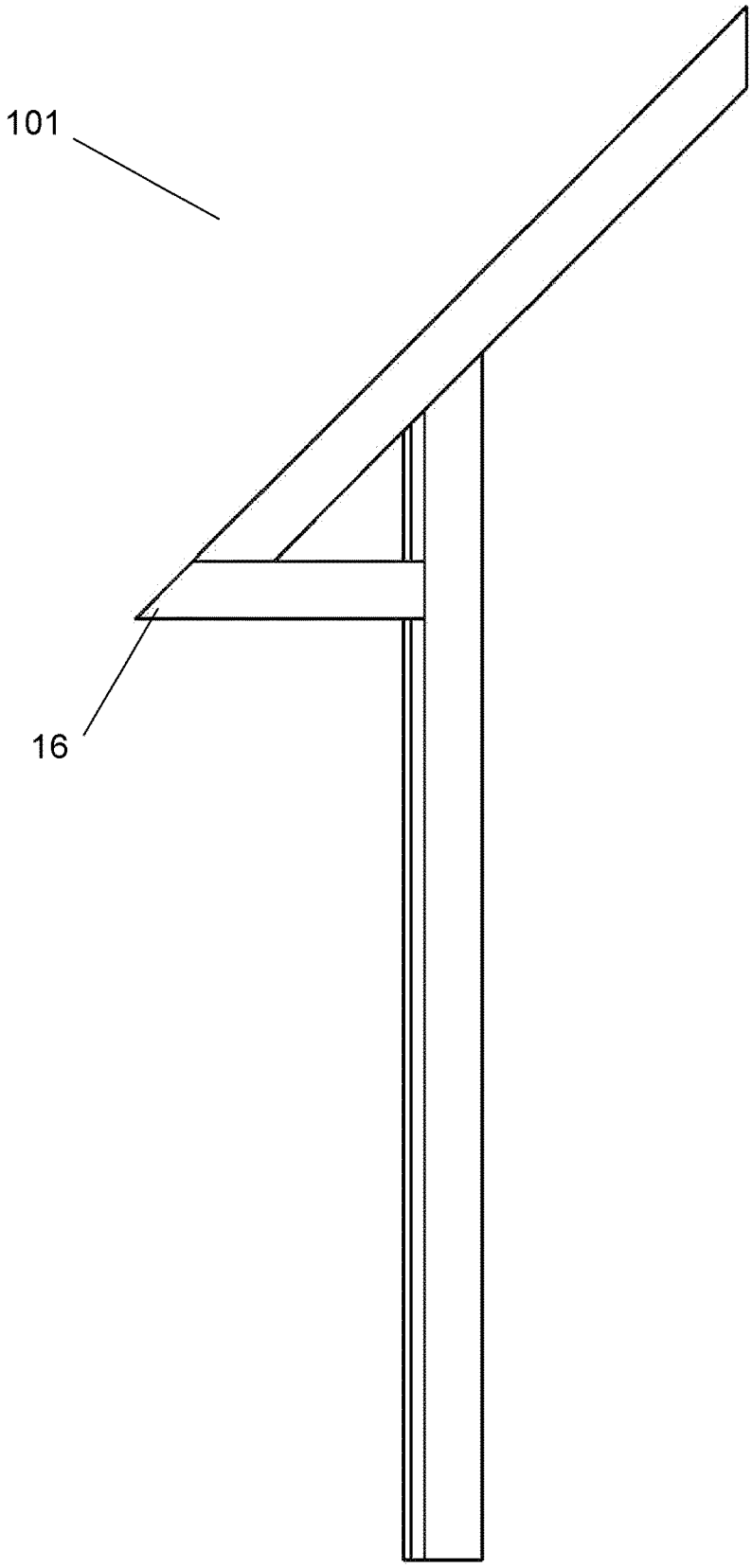
FIG. 22 is a left side elevation view of FIG. 20 thereof, with the right side elevation view being a mirror image.
Figure 23:
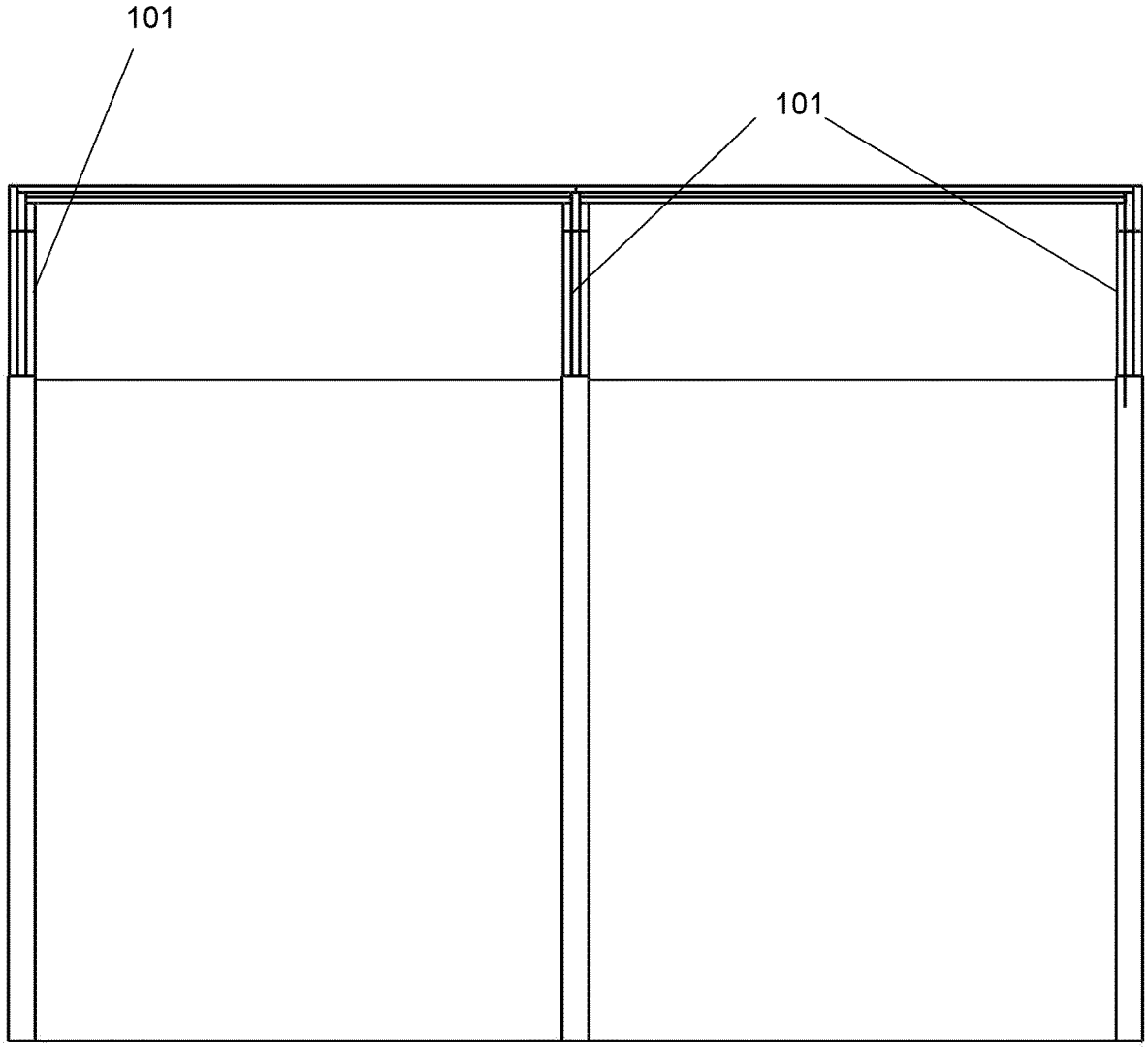
FIG. 23 is a front elevation view of FIG. 20 thereof.
Figure 24:
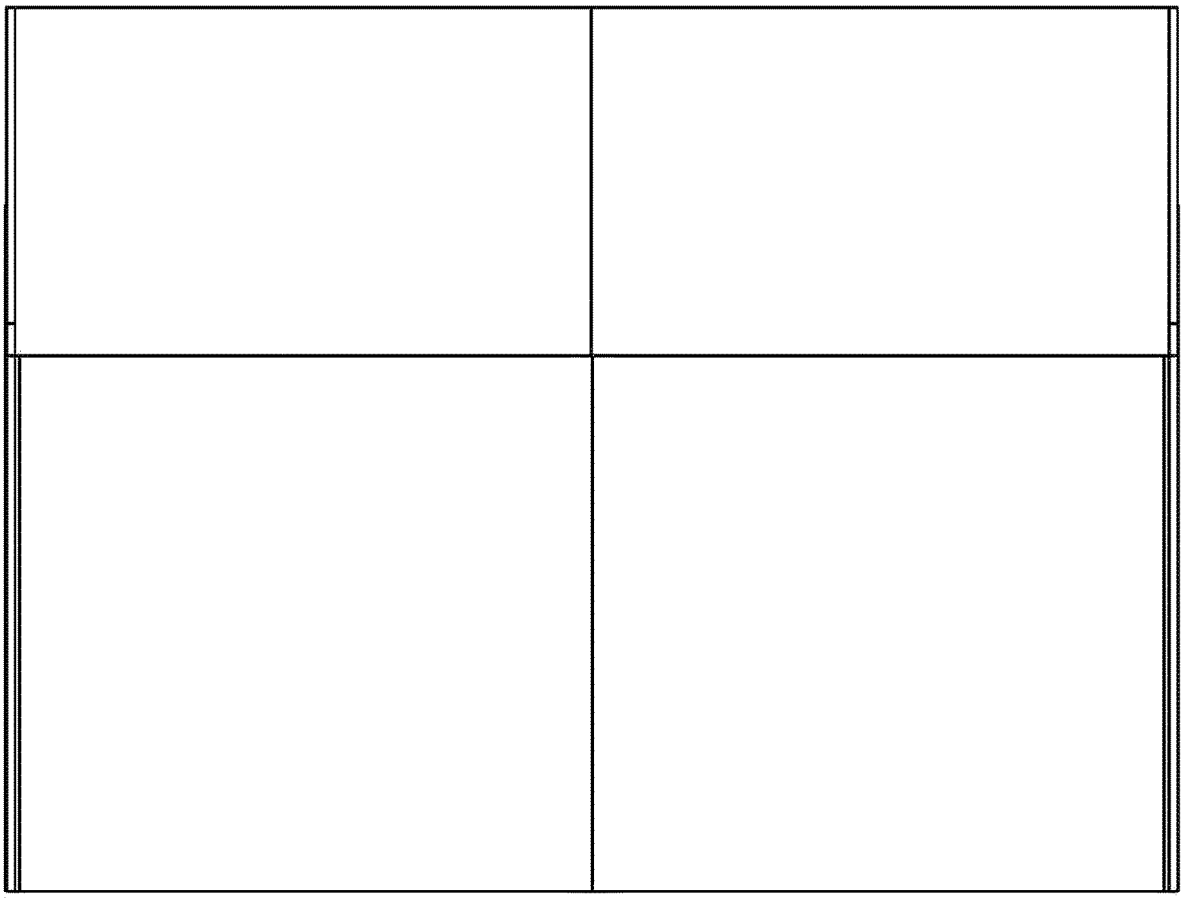
FIG. 24 is a rear elevation view of FIG. 20 thereof.
Figure 25:
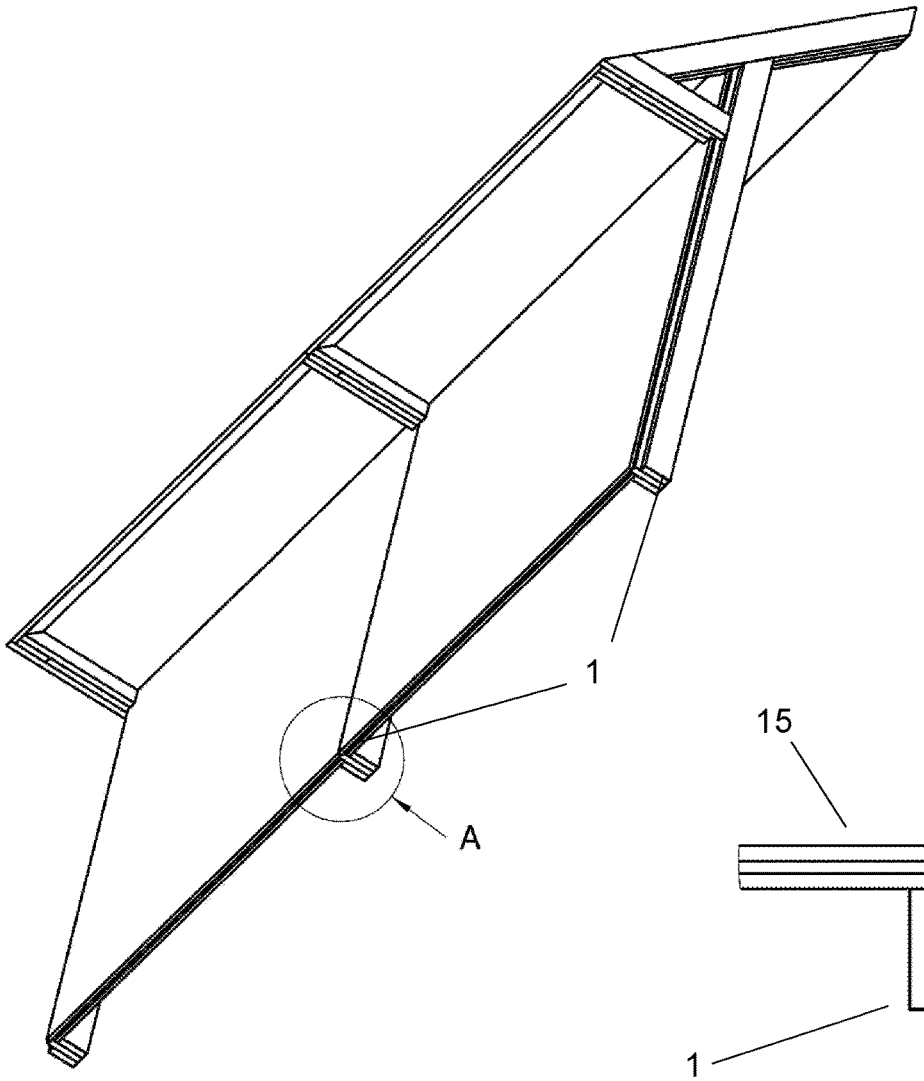
FIG. 25 is another perspective view of FIG. 20 thereof.
Figure 26:
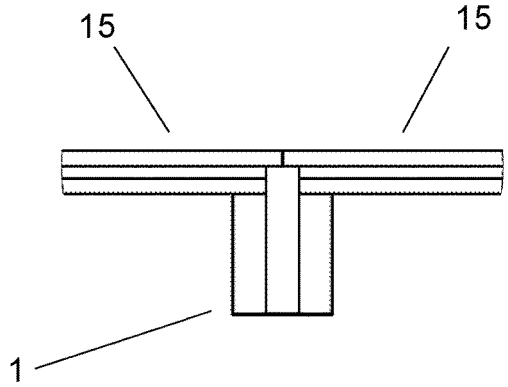
FIG. 26 is is an exploded elevation view of FIG. 25 thereof.
Figure 27:
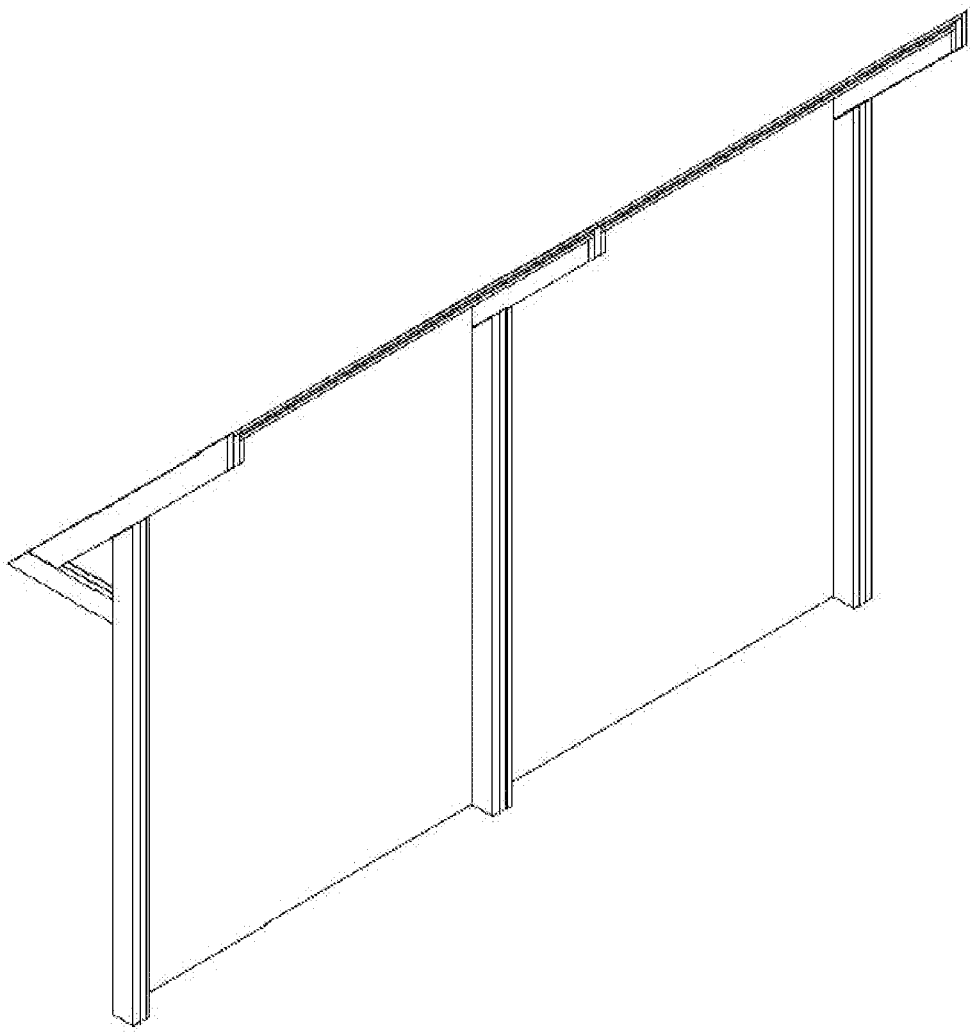
FIG. 27 is is another perspective view of FIG. 15, with the plurality of surface attachment members removed.
Figure 28:
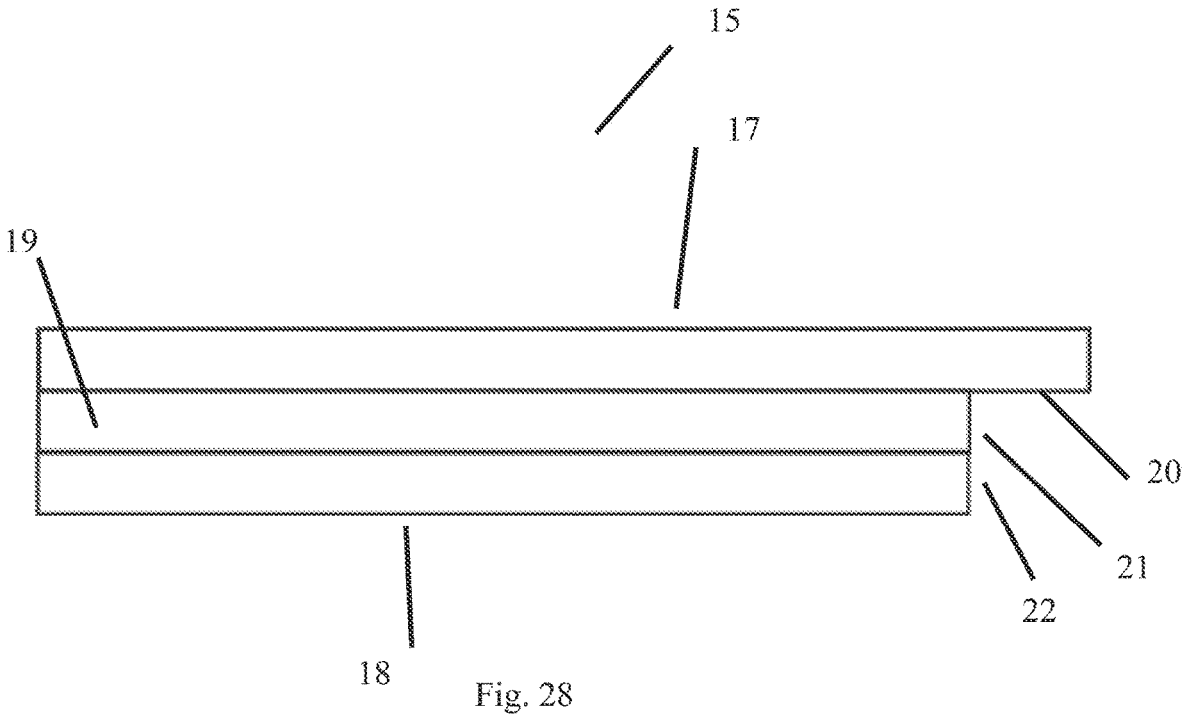
FIG. 28 is an elevation view of an excerpt of a modified structural insulated panel, showing at least one side having an outer skin overhang with a recessed foam core and a recessed inner skin.
Figure 29:
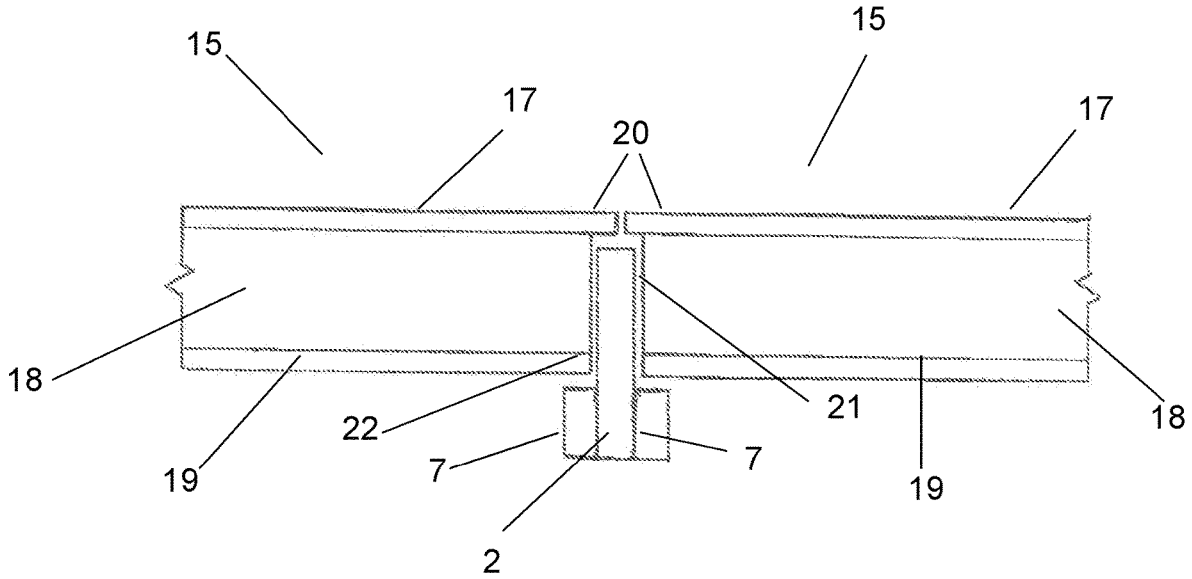
FIG. 29 is another elevation view of the modified structural insulated panels assembled with a spline.
Figure 30:
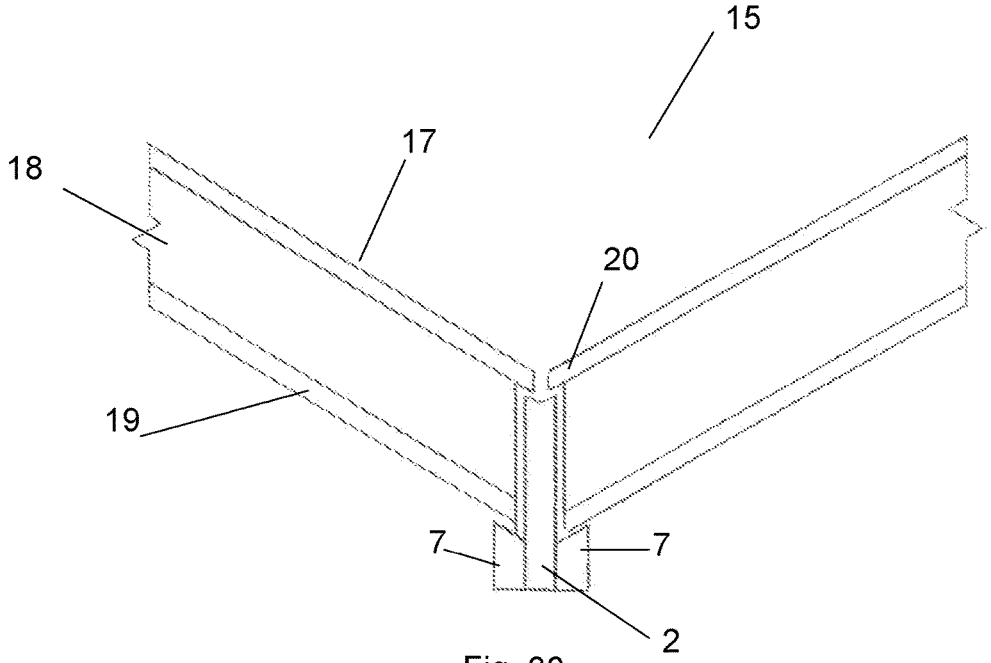
FIG. 30 is another view of the framing assembly in use.

As shown in FIGS. 20-30, the framing assembly uses modified splines 1, 101, modified structural insulated panels 15, and surface attachment members 14 to construct a building structure resembling a timber frame, exposed beams, or exposed columns. Conventional splines insertably mounted between conventional SIPs are replaced by modified splines that are insertably mounted between modified SIPs. Although various types of wall panels, ceiling panels, and roof panels may be used, the preferred materials are modified SIPs. Each spline is lighter and more cost effective than using a heavy beam or heavy column. The design and structure of the splines carry the required load of the panels and the roof.

The wall splines 1 are arranged as a vertical element or upstanding column used to connect the wall panels 15 together. When not used as a column, the modified wall spline may be alternatively interchanged with a conventional wall spline without the pair of flanges. The rafter splines are arranged as rafters or beams to connect ceiling panels or roof panels together. More particularly, a lower, wider portion of each wall spline, each rafter spline, and each extended rafter spline are mounted between the respective wall panel sections, ceiling panel sections, or roof panel sections. By sandwiching the wall splines between two panels, the resulting frame is more rigid and does not need additional bracing. A plurality of fasteners secures each of the splines to the panels.

Figure 2:
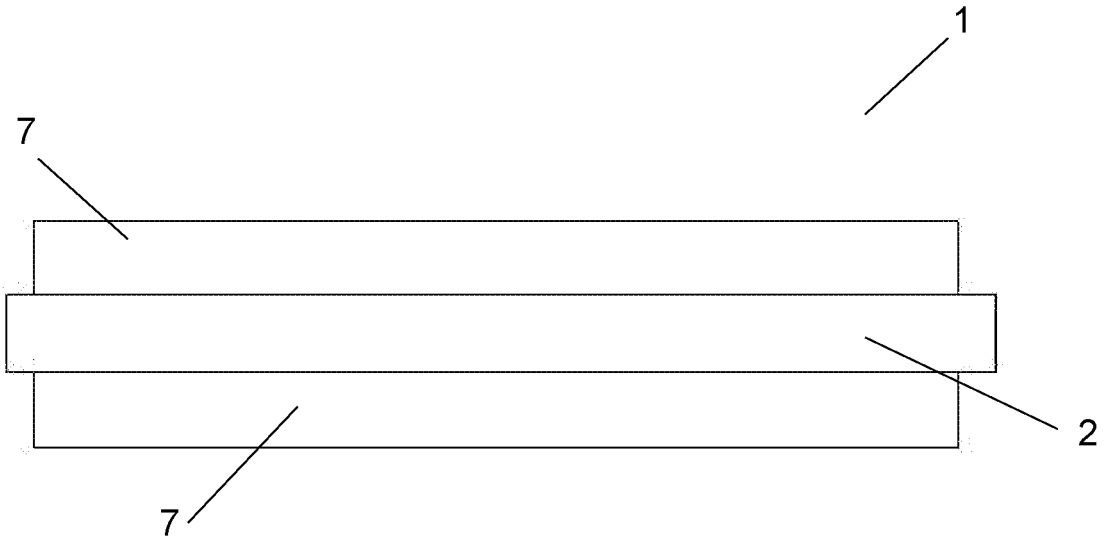
FIG. 2 is is a top plan view thereof.
Figure 3:
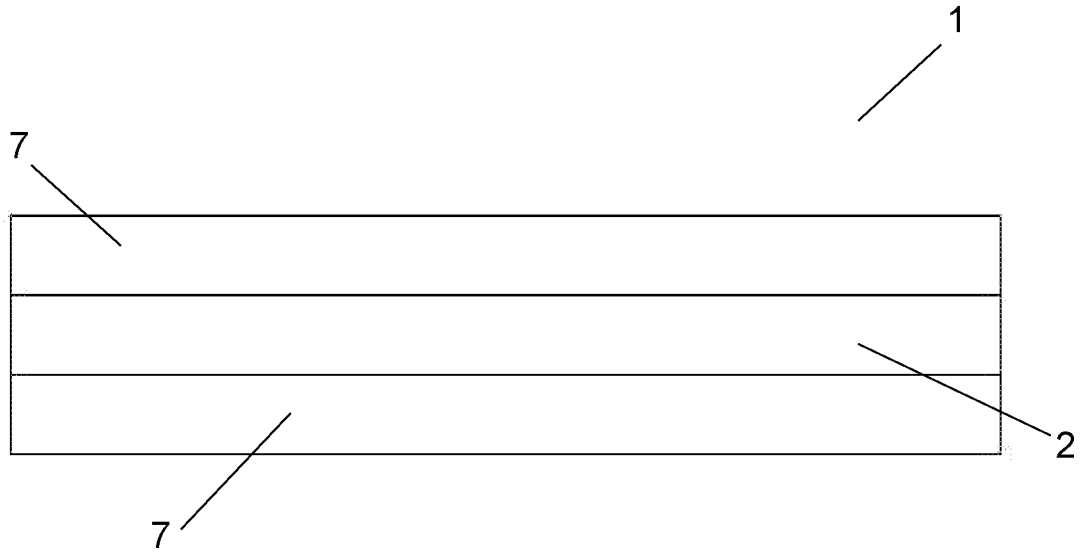
FIG. 3 is a bottom plan view thereof.
Figure 4:
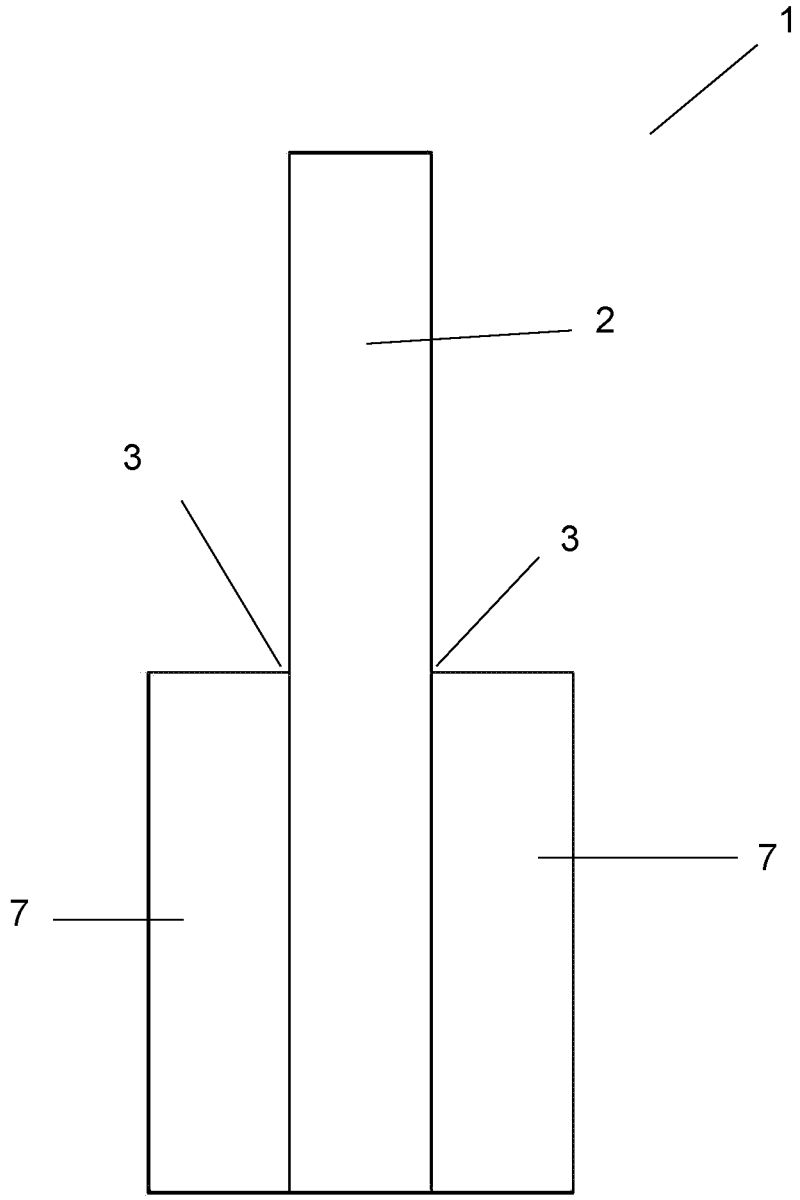
FIG. 4 is front elevation view thereof.
Figure 5:
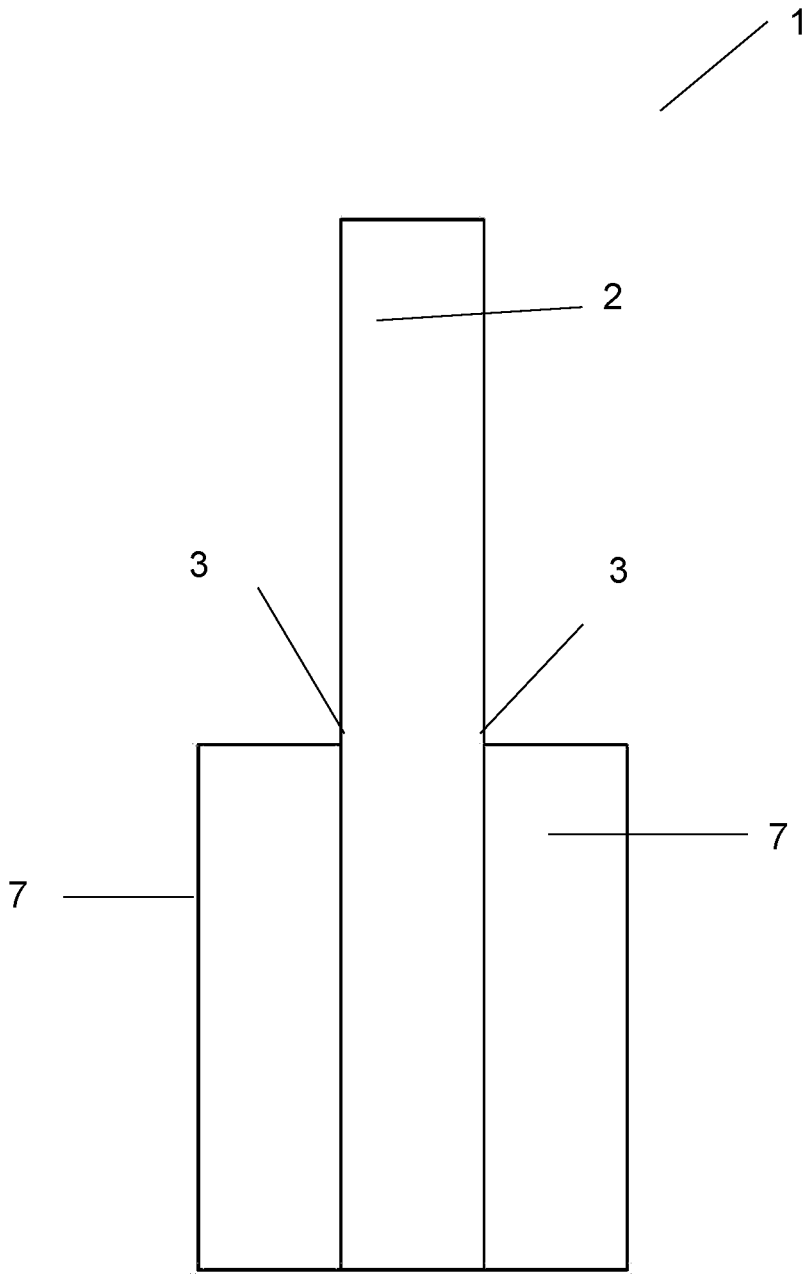
FIG. 5 is is a rear elevation view thereof.
Figure 6:
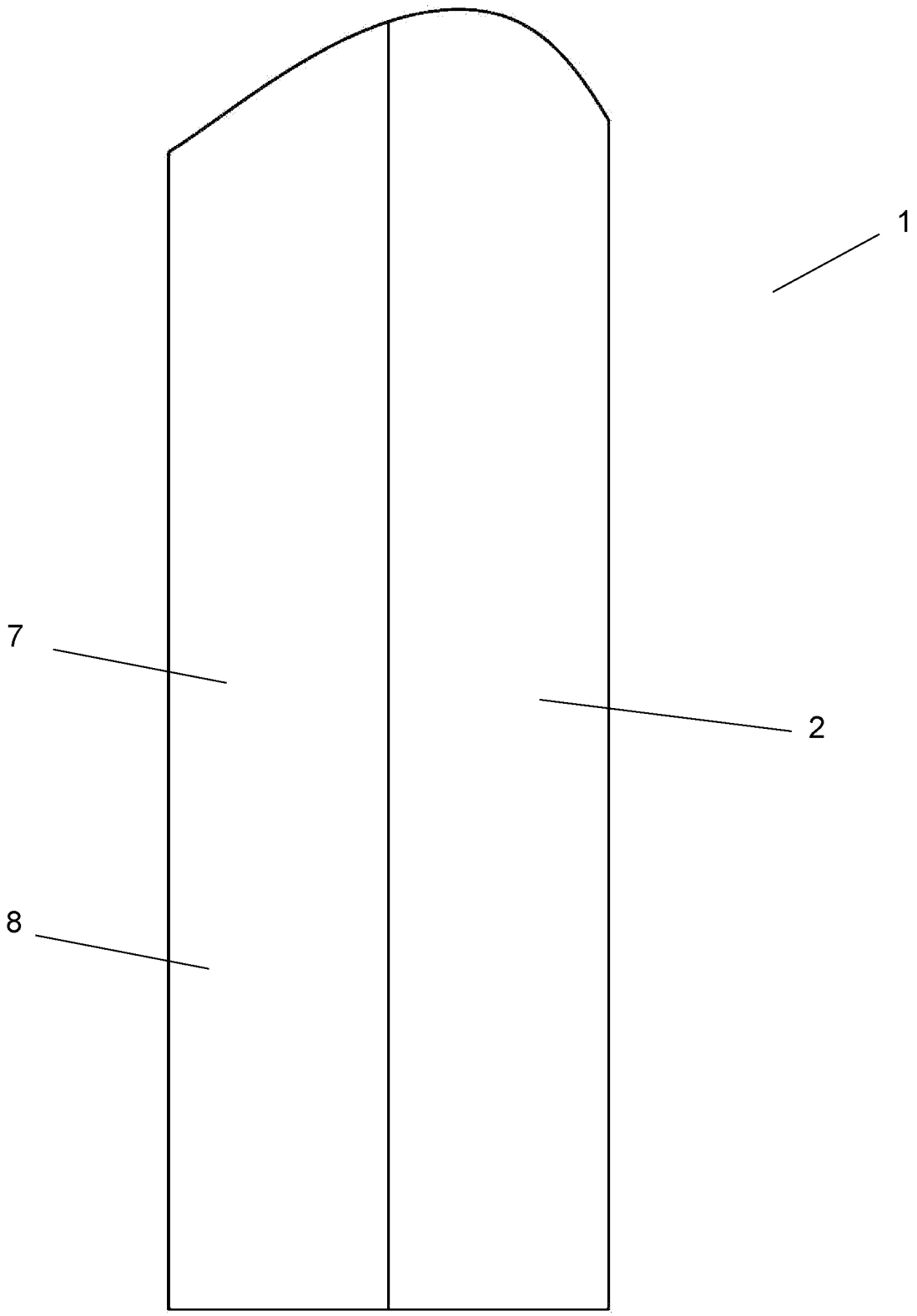
FIG. 6 is is a left side elevation view thereof, with the right side being a mirror image.
Figure 7:
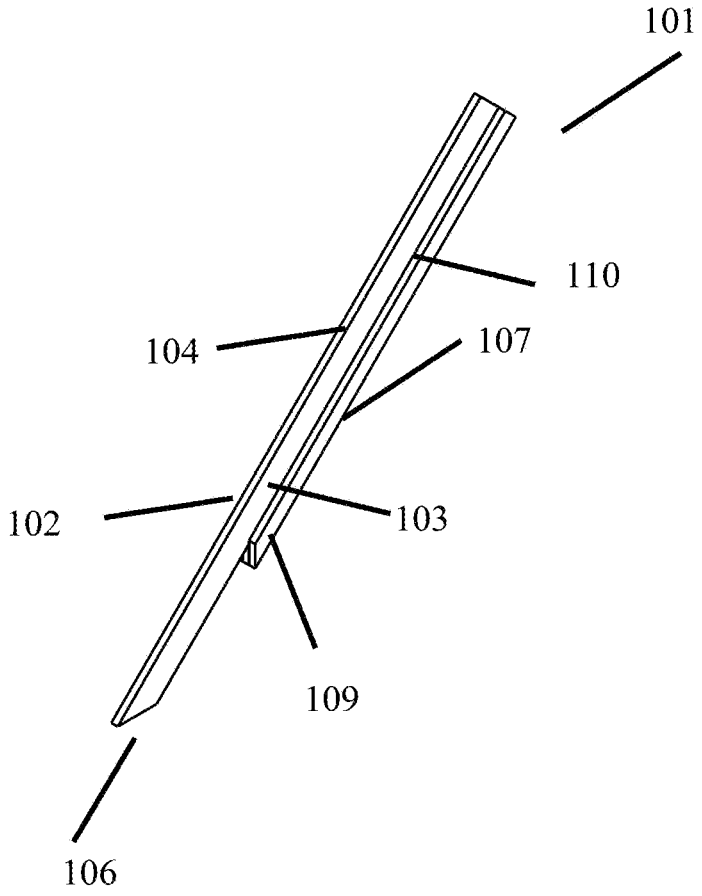
FIG. 7 is a perspective view of an extended rafter spline of the framing assembly.
Figure 8:
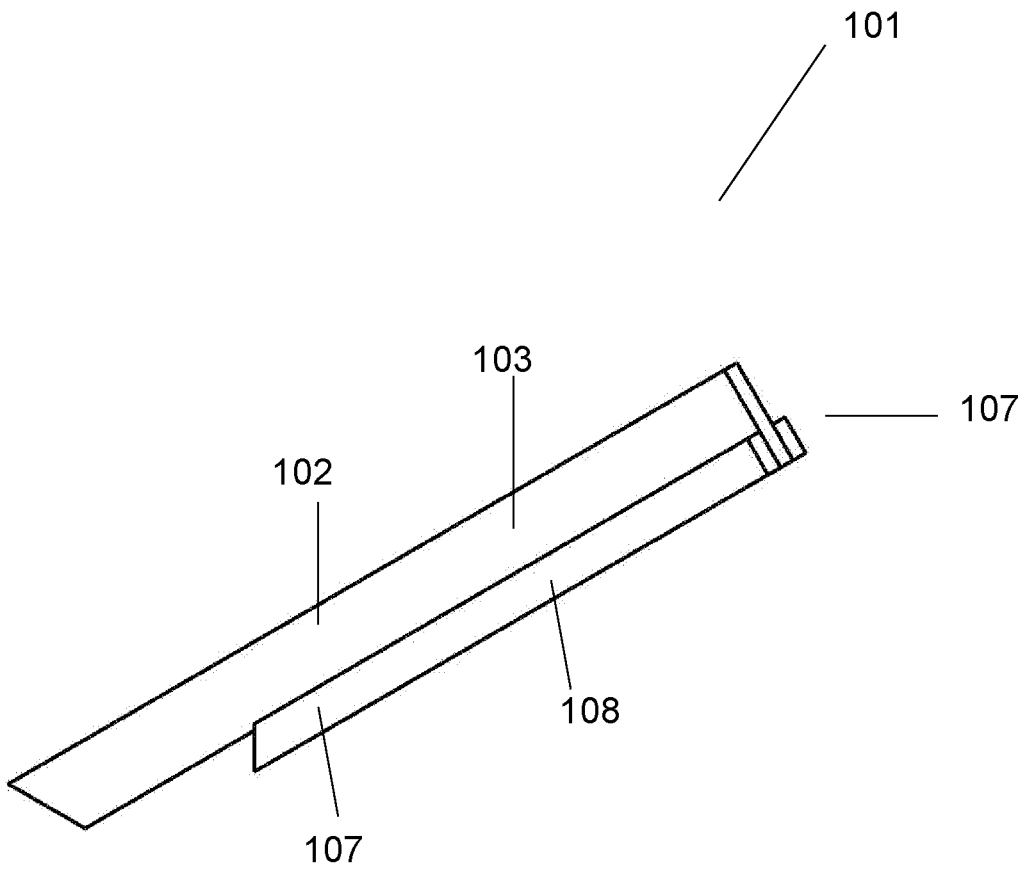
FIG. 8 is another perspective view of FIG. 7 thereof.
Figure 9:
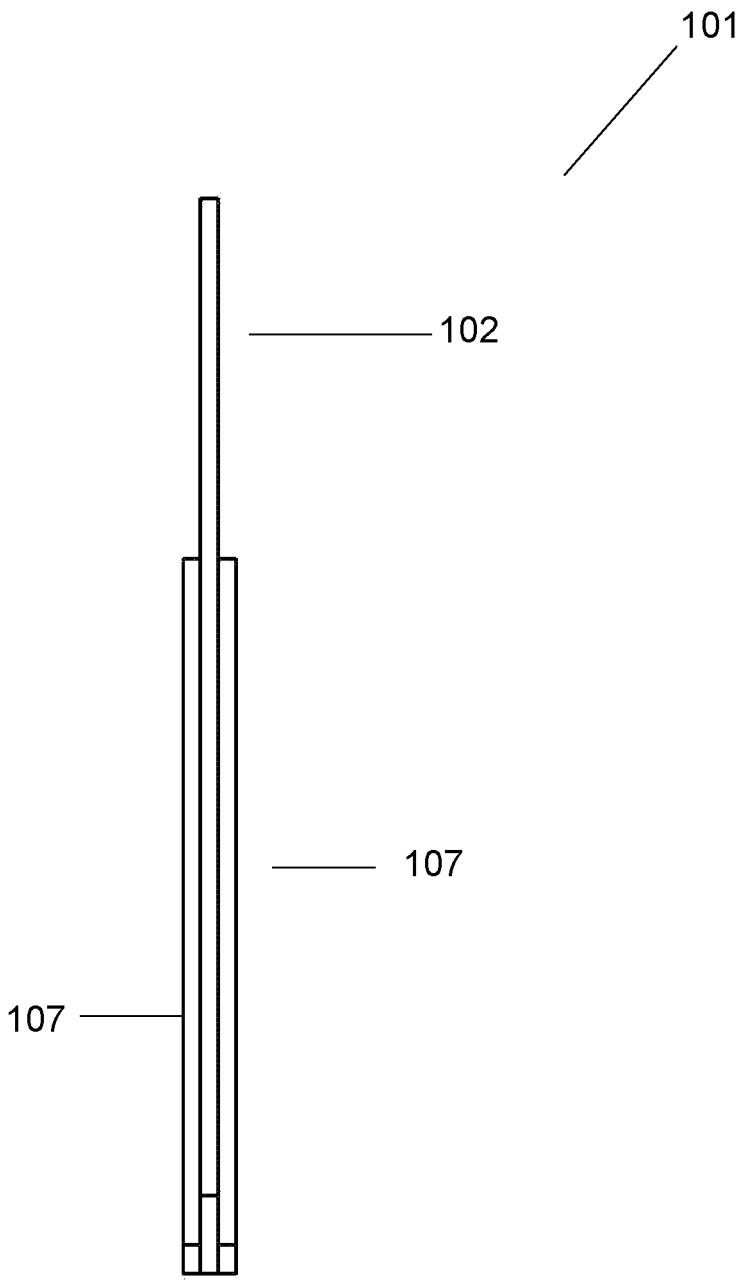
FIG. 9 is a top plan view of FIG. 7 thereof.
Figure 10:
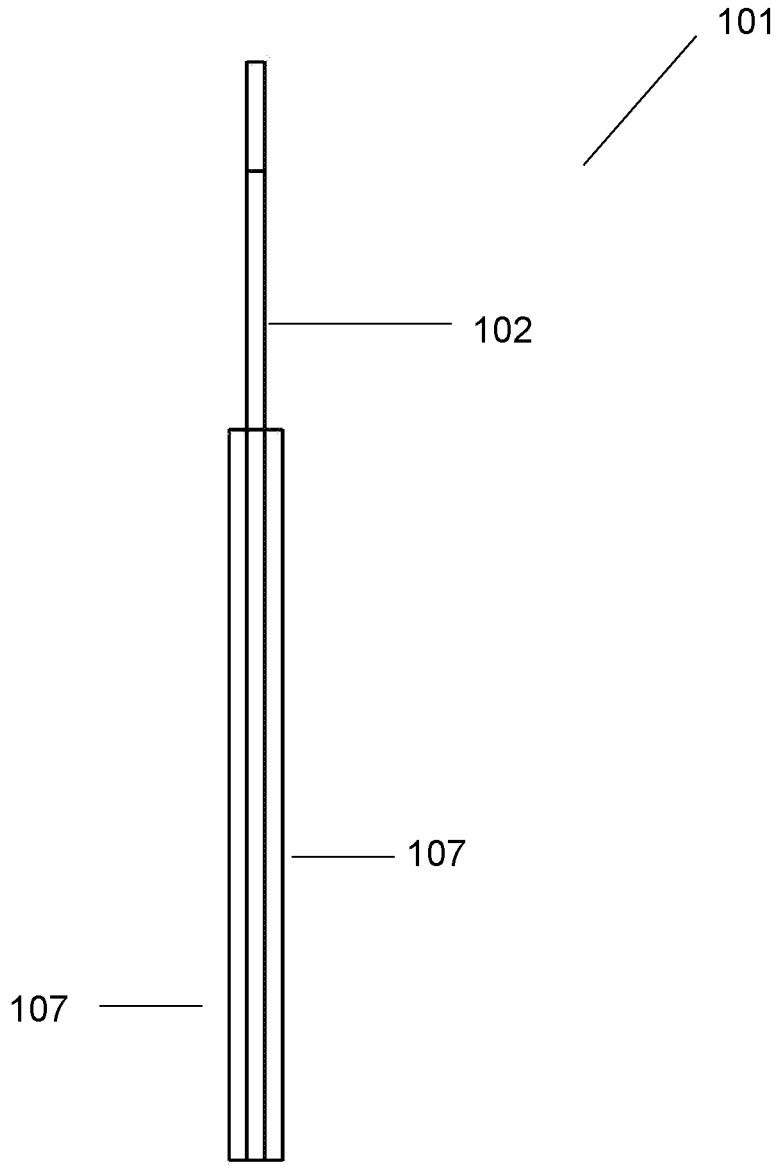
FIG. 10 is a bottom plan view of FIG. 7 thereof.
Figure 11:
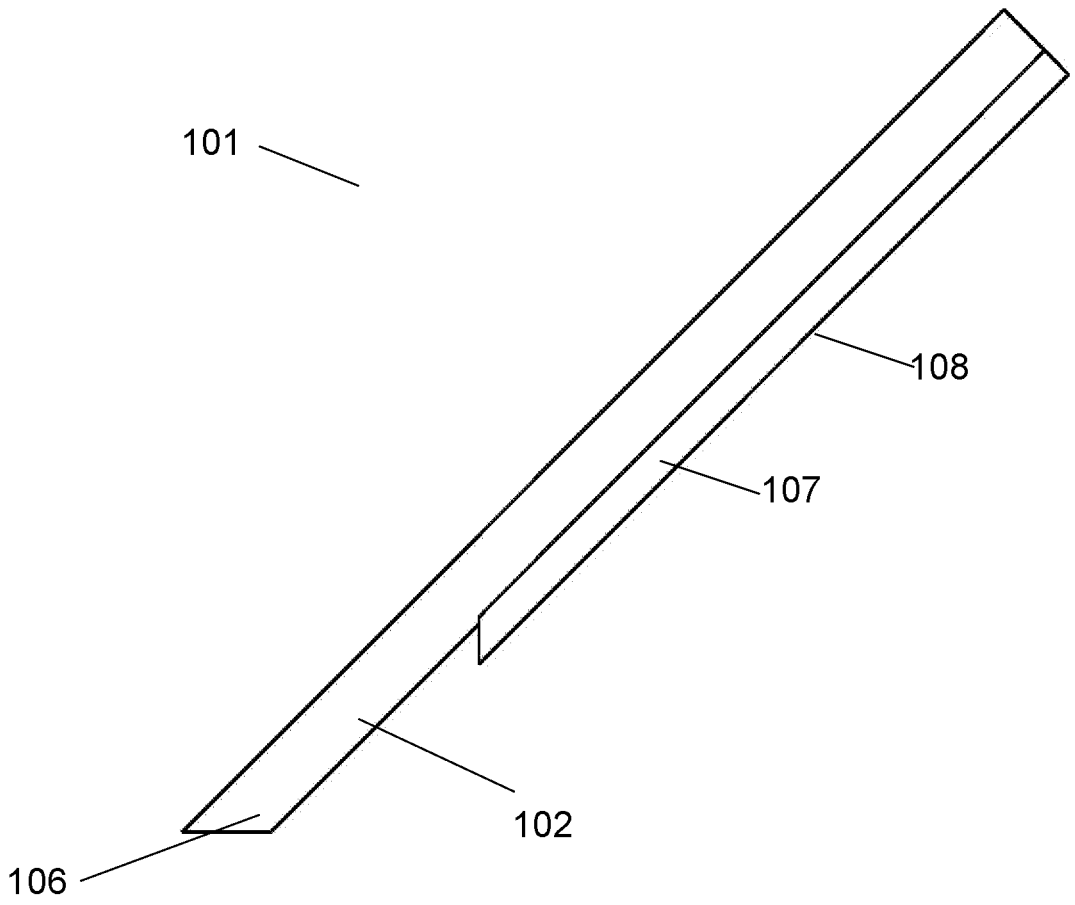
FIG. 11 is a left side elevation view of FIG. 7 thereof.
Figure 12:
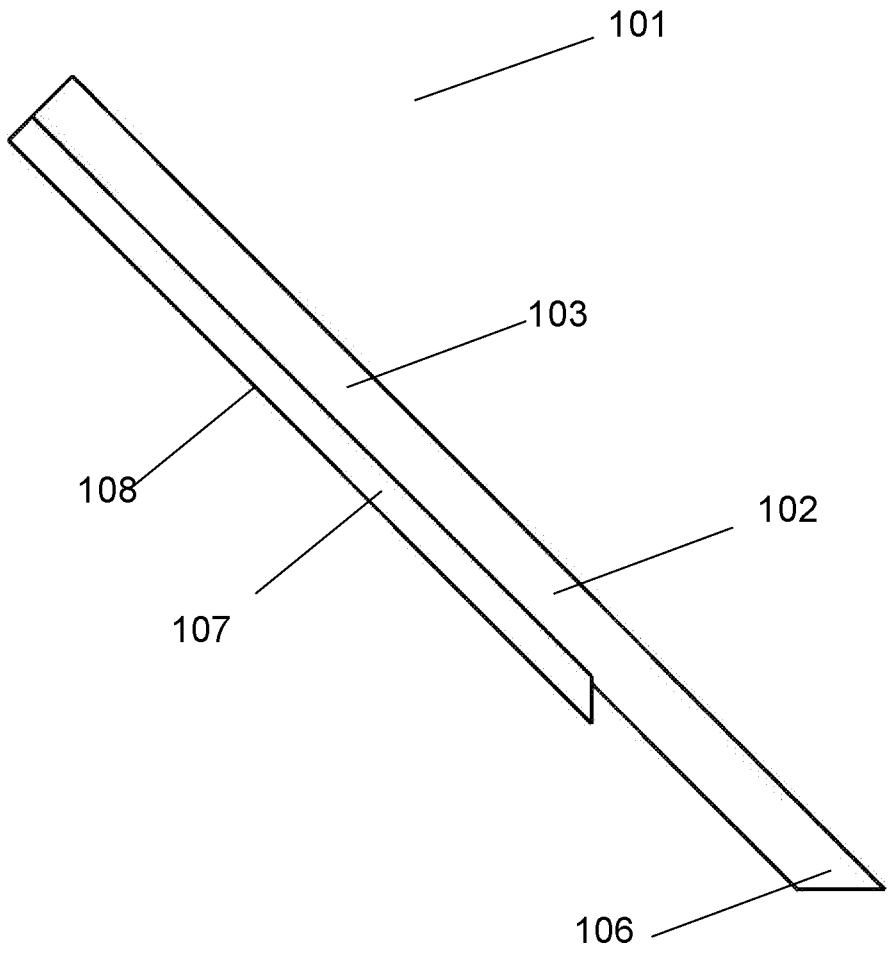
FIG. 12 is a right side elevation view of FIG. 7 thereof.
Figure 13:
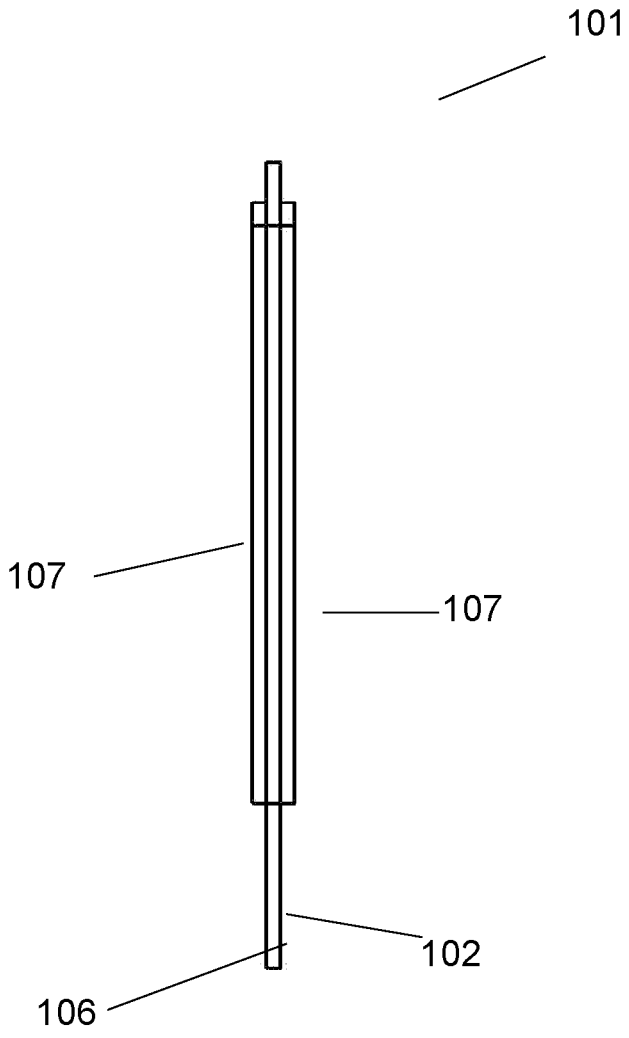
FIG. 13 is a front elevation view of FIG. 7 thereof.
Figure 14:
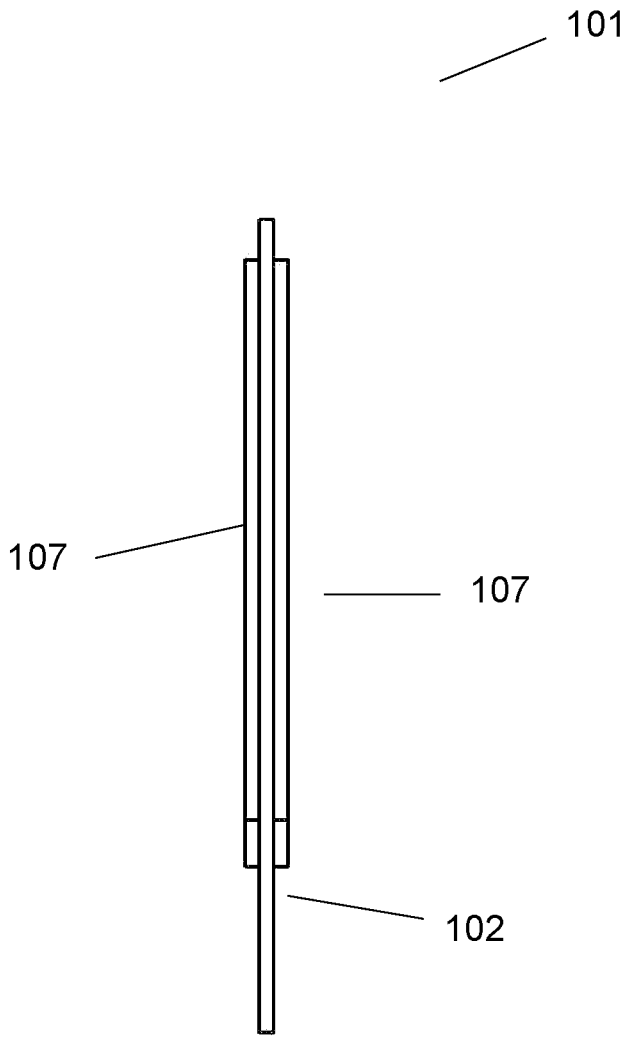
FIG. 14 is a rear elevation view of FIG. 7 thereof.

As depicted in FIGS. 1-14, each of the plurality of splines 1, 101 has a support member 2, 102, and a pair of flanges 7, 107. Each flange 7, 107 abuts a lateral side 3, 103 of the support member 2, 102. The spline resembles a T-shaped beam, with the support member flanked by flanges forming the lower, distal, and bottom portion of the spline. The abutted seams of the support member and flanges may be visible until covered with a surface material attachment 14. Using a unitary spline without seams is not recommended. The upper, proximal, or top portion of the spline is the support member. This upper portion of the spline 1, 101 has a width smaller than a width of the lower portion of the spline 1, 101 due to the pair of flanges sandwiching the lower portion of the support member.

In a preferred embodiment shown in FIGS. 20-30, the plurality of splines may be used as a plurality of wall splines, a plurality of rafter splines, or a plurality of extended rafter splines, with the support member of each of these types of splines having substantially same length as a length of each of the pair of flanges that flank the support member. With the plurality of extended rafter splines, one end of the support member of the extended rafter spline has a length longer than a length of each of the pair of flanges that flank the support member.

Each wall spline is essentially a wall stud alternative for supporting the wall panels and for supporting the weight or load of the roof of the building structure, and for providing an exposed upstanding column appearance. Each rafter spline and each extended rafter spline is essentially a rafter for supporting the ceiling panels and the roof panels, and for supporting the weight or load of the ceiling and the roof of the building structure. The extended rafter splines may be further used to form a soffit of the roof line. A user may selectively decrease the depth of the exposed lower, exposed beam portion of the spline by trimming or cutting off the excess material. The length of each spline may extend from floor to ceiling for wall splines/columns or wall to wall for rafter splines/beams. To extend the length of a wall spline or a rafter spline beyond the length of the available materials, another respective wall spline or rafter spline is positioned to align and abut the other spline.

The support member 2, 102 may be part of a wall spline, a rafter spline, or an extended rafter spline. Each support member of a spline is preferably made of structural composite lumber ("SCL"), although other comparable materials may be used. The length of each spline and corresponding support member depend on the specifications for constructing the building structure and depends on the pitch and length of the roof. For example, the splines may be 20 to 24 feet long. Using SCL for the spline support member provides more accuracy and desired length in the construction. The width of the support member ranges from approximately 1.5 inches up to 3 inches, depending on the required load. The wall spline dimensions range from 2-inch×4 inch or 2-inch×6-inch studs or columns. The rafter spline dimensions range from 2-inch×8 inch, 2 inch×10 inch, or 2 inch×12 inch rafters. An example of a preferred support member dimensions is 2-inch width×16-inch depth/height×20-foot length. The dimensions used for a rafter spline or an extended rafter spline will depend on the size of the support member SCL, the flanges DL, and the pitch and length of the roof. The spline support member may be mounted and secured with truss plates, bend plates, or other connecting members.

As shown in the figures, the distal or lower portion of the support member 2, 102 is sandwiched between the two flanges 7, 107, with the distal, lower, or second end of the support member 2, 102 being aligned with the distal, lower, or second end of the two flanges 7, 107. The proximal or upper portion of the support member is upstanding and has a depth (or height) longer than a depth (or height) of the flanges. The size of the flanges may range from 2 inch×4 inch board, 2 inch×6 inch board, 2 inch×8 inch board, 2 inch×10 inch board, or 2 inch×12 inch board, depending on the specifications for constructing the building structure. The width of each flange is preferably equal to or less than half the width of the support member.

The pair of flanges may be a component of a wall spline, a rafter spline, or an extended rafter spline. Each flange of a spline is preferably made of dimensional lumber ("DL") board, although other comparable materials may be used. Each flange is essentially a mirror image to the corresponding flange. The one lateral side 8, 108 of the flange is permanently adhered to the lateral side 3, 103 of a particular support member, leaving the opposing lateral side 8, 108 of the flange exposed. Each flange is adhered to the support member by an adhesive member, then pressure is applied to further adhere the flange boards to the support member. The adhesive member is preferably glue or other high-grade construction bonding material. Fasteners, preferably screws or bolts, may be used to further secure the flange boards to the support member.

The top of the flange 7, 107 board creates a ledge 10, 110 to support the wall panel section 25, the ceiling panel section 25, or the roof panel section 25. Using the flanges provides a method of building a structure having exposed beams without relying on additional framing elements. The bottom 5 of the adhered flanges 7, 107 and support member 2, 102 form a flat surface upon which a surface attachment member 14 may be attached. Each wall flange has a length substantially the same as the wall support member. In the preferred embodiment shown in the figures, each wall flange is essentially a substantially rectangular or straight-edge shaped column and may be selectively used along any section of wall. The rafter flanges are essentially the same as the wall flanges, but are considered upstanding beams.

In another embodiment, one or both rafter spline flanges are angled for use as in a rafter valley. Here, the angle may range from 30 degrees-45 degrees depending on the pitch of the roof, for example, a roof having a 6/12 pitch versus a roof having a 12/12 pitch. A valley rafter spline having angled flanges would carry more load than a top rafter spline, because the valley rafter spline is typically larger than the top rafter spline. An angled or beveled flange may also be used when joining outer roof panels to form a roof valley or a hip roof. The flange angle would be determined by the angle needed to join the outer panels. This framing assembly may further include a collar tie or a rafter tie to form a truss.

Figure 15:
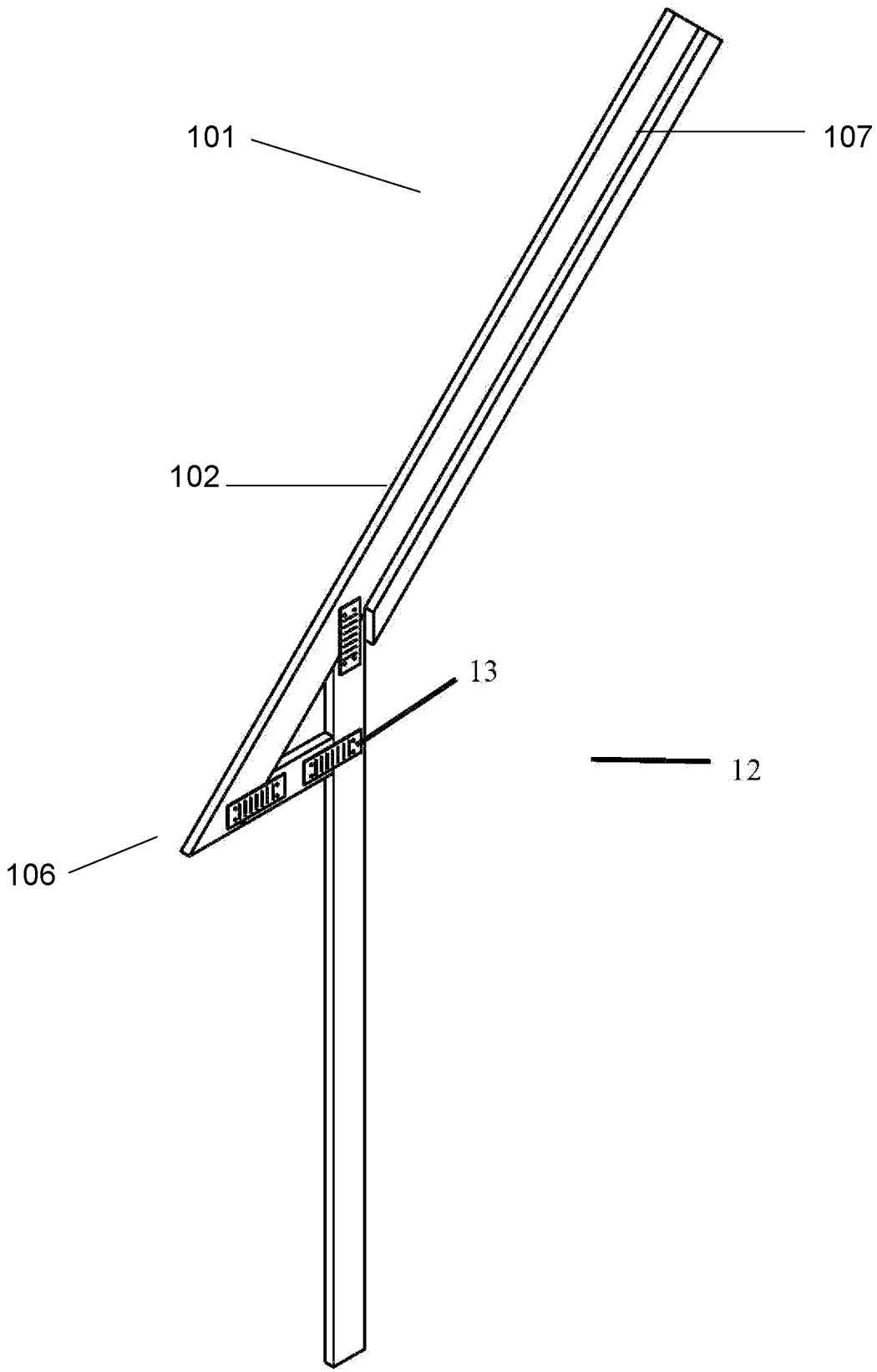
FIG. 15 is a perspective view, showing an extended rafter spline coupled to a wall spline, shown in use.
Figure 16:
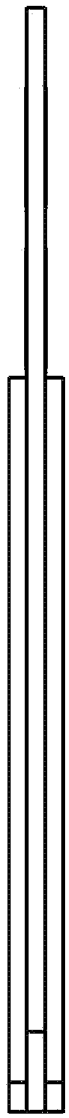
FIG. 16 is a top plan view of FIG. 15 thereof.
Figure 17:
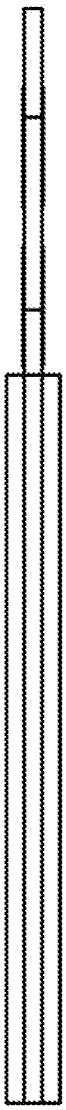
FIG. 17 is a bottom plan view of FIG. 15 thereof.
Figure 18:
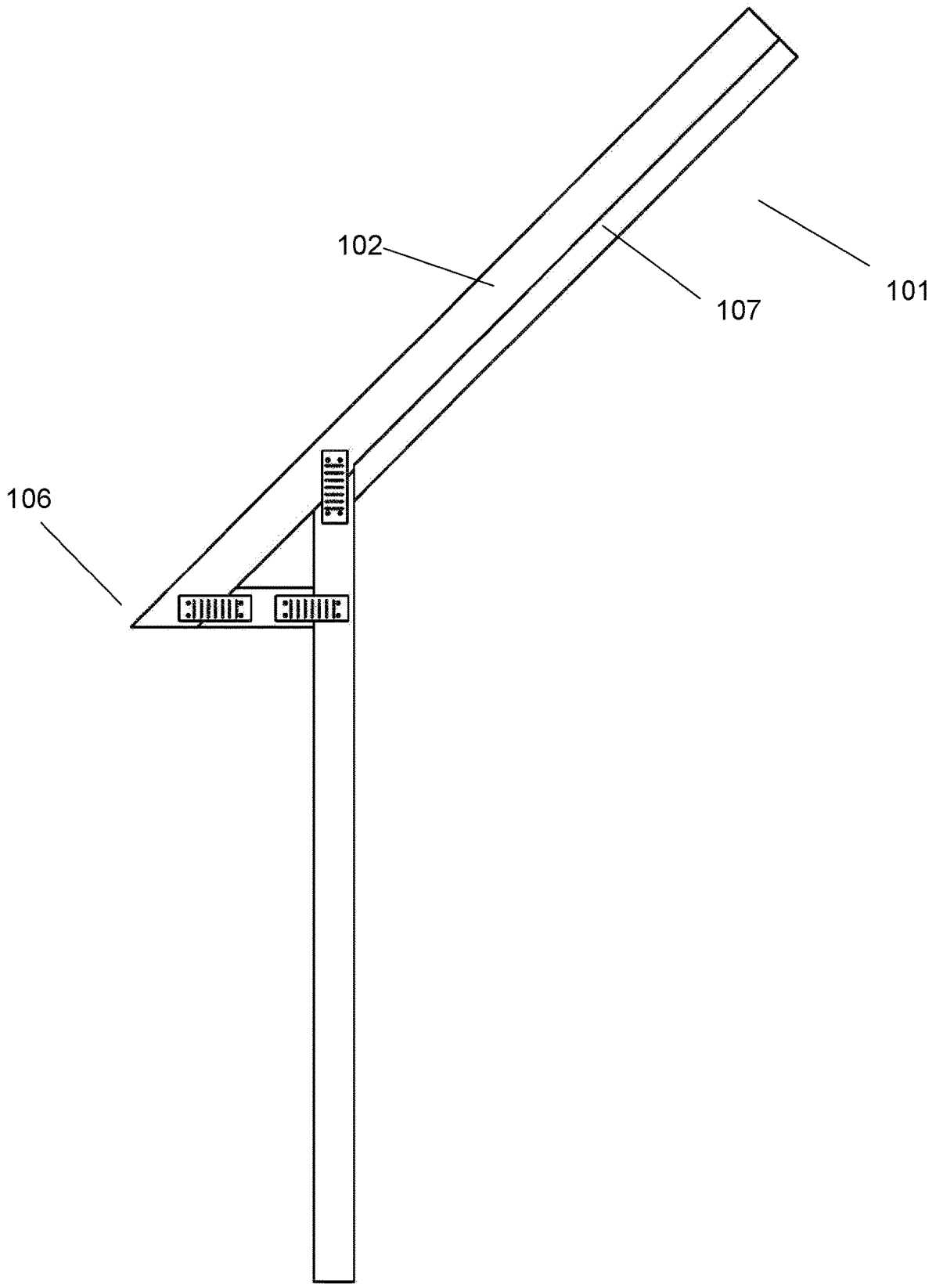
FIG. 18 is a left side elevation view of FIG. 15 thereof, with the right side elevation view being a mirror image.
Figure 19:
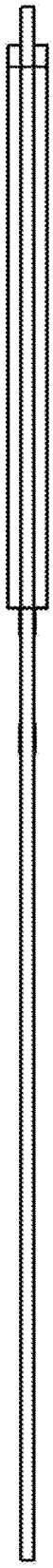
FIG. 19 is a front plan elevation view of FIG. 15 thereof.

For the embodiment depicted in FIGS. 15-19 wherein extended rafter splines are used, the end of each flange 107 abuts the top 4 of the wall spline 1 at an angle 109, with the rafter support member also terminating at an angle 106 as a rafter tail that extends beyond the wall to form part of an eave overhang. When used as part of a rafter spline 1 or an extended rafter spline 101, the support member 102 may be mounted to one or more connecting members 16, such as truss plates or bend plates.

A surface attachment member 14 may be applied to the end of the lower portion of the spline. The surface treatment used as the surface attachment may be selected from the group consisting of paint, spray, veneer, backing, or combinations thereof.

The rafter splines may further include rafter ties to form a truss, as needed. Each upstanding end of a wall spline may be further fastened or otherwise coupled to a corresponding rafter spline, with the opposite end of the rafter spline being fastened to another rafter spline arrangement forming a frame that can be raised into position.

The modified SIP inner skin 22, and where applicable the preferred foam core 21, is trimmed to accommodate the spline 1, 101, leaving the unmodified outer skin 17 with an overhang 20 to essentially form an L-shape of the SIP 15. The outer skin 17 overhang 20 of the modified SIP 25 is approximately half the width of the spline 1, 101 support member 2, 102. The figures depict the assembly of the outer 17 skin overhang 20 of two modified SIPS 25 may be secured to the top 4, 104 of one spline 1, 101 support member 2, 102. When the spline is installed with the modified wall SIP, ceiling SIP, or roof SIP, part of the top of the spline support member abuts the underside of the outer skin overhang, with the lateral side of the upper portion of the spline support member abutting the trimmed foam core and the inner skin, and with the exposed outer-side of the inner skin abutting the top of one of the spline flange ledges. The modified SIP is secured to the spline with a plurality of fasteners. The fasteners used to secure the SIP to the flange ledge must be long enough to penetrate the entire cross section of the SIP panel and into the spline flange. The installation process is repeated for a second, adjacent modified SIP, with the overhang outer skin of the second modified SIP positioned over the unencumbered part of the top of the spline support member. The framing assembly, with the assembled sections of modified SIPs and splines, may be raised or otherwise positioned into place in the building structure. The exposed side of the assembled modified SIPs outer skins form a continuous surface.

During installation, the bottom of the modified SIPs is coupled to a sill plate that is mounted to the floor. The bottom of the modified SIP retains the conventional recess of the foam core within the outer skin and inner skin for coupling to the sill plate. The modified SIP wall panel height is determined by the desired eave height of the building and the location of where the roof and walls meet. The roof/ceiling SIP panels preferably has a depth of approximately 6 inches or 8 inches, depending on the R value or the amount of insulation required for the building. Each SIP wall panel preferably has a depth or thickness of approximately 6 inches or 4 inches. If a surface attachment member is applied to the lower portions of the splines, the user may elect to apply the surface attachment member to all three sides of the exposed spline, to two sides of the exposed spline, or to only one side of the exposed spline.

The framing assembly may further include an eave. The eave includes a lookout 29 upstanding from and mounted to a soffit 28. The lookout is essentially a board or other structural material having a top, a bottom, two opposing lateral sides, a distal end, and a proximal end. The distal end of the lookout is closest to the building structure, while the proximal end is near the roof overhang. The lookout proximal end is fastened to the modified rafter spline (rafter tail) and fastened at the distal end to a wall spline. The eave provides additional strength and stability to the building frame in addition to straightening the walls. A mend plate, truss plate, or stud strap may also be used to attach the lookout to both the extended rafter spline and to the wall spline.

The soffit is mounted to the bottom of the lookout. The soffit extends beyond the length of both the lookout and the extended rafter spline (or other roof tail) by approximately ½ inches. The soffit may be made from long engineered wood members, preferably strand boards, and may further define a groove therein. The soffit, lookout, and extended roof spline form a truss so that the roof load is transferred to a bending moment. The soffit acts as a beam and counteracts the bending moment. This configuration results in a stronger, stiffer exterior wall. This arrangement is particularly useful for vaulted ceilings.

A fascia header may be added via the soffit groove. The framing assembly may further include collar ties, rafter ties, or both to further strengthen the structure. The ties may be made from the same material as the rafter splines or it may be made out of metal. The ties may be used for structural purposes, ornamental purposes, or both.

The roof panel sections lay over the outer skin of the roof SIP or ceiling SIPs. A crane is not needed during this construction. The sections may weigh approximately 200-300 pounds, but may be winched and lifted into place before fastening—all without using a crane. When a ridge beam is used, two rafter splines are joined and fastened together to form a straight roof peak. When a ridge beam is not used, a truss plate connects two rafter splines to form the roof peak.

In yet another embodiment of the invention, a framing assembly for constructing the frame of a building structure having at least one exposed beam, the framing assembly comprising:

a. a plurality of rafter splines, each of the plurality of rafter splines comprising a support member having a lower portion and an upper portion, and a pair of flanges, with the support member having a depth or height more than a depth or height of each of the pair of flanges, and with each of the pair of flanges abutting and being affixed to the lower portion of the support member a lower portion of the rafter spline and with the upper portion of the support member forming the upper portion of the rafter spline;

b. a plurality of extended rafter splines, each of the plurality of extended rafter splines comprising an extended rafter support member and a pair of flanges, i. the extended rafter support member having a lower portion, an upper portion, a first end separated from a second end by a longitudinal body, with the longitudinal body of the extended rafter support member having a length longer than a length of each of a pair of flanges and extending beyond a roof of the building structure as a rafter tail to form part of an eave; and ii. the pair of rafter flanges, with the extended rafter support member having a depth or height more than a depth or height of each of the pair of flanges, with each of the pair of flanges abutting and flanking the lower portion of the extended rafter support member forming a lower portion of the extended rafter spline, and with the upper portion of the extended rafter support member forming an upper portion of the extended rafter spline;

c. a plurality of structural insulated panels, each structural insulated panel comprising an outer skin having a top, a bottom, and at least one side; a core within the structural insulated panel, the core having a top, a bottom, an end and at least one side; and an inner skin having a top, a bottom, an end, and at least one side, with the outer skin, the core, and the inner skin mounted together as a layer of the structural insulated panel further, with the structural insulated panel further comprising at least one side of each of the outer skin, the core, and the inner skin, and with at least one side of the top of the outer skin forming an overhang over at least one recessed side of the core and the inner skin;

d. wherein at least one the plurality of rafter splines or at least one of the plurality of extended rafter splines is coupled to the at least one panel side of the plurality of structural insulated panels by abutting a portion of the top of the respective rafter spline support member or extended rafter spline support member against an underside of the structural insulated panel outer skin overhang, by abutting the upper portion of a lateral side of the respective rafter spline support member or extended rafter spline support member against both the end of the recessed core and the inner skin of the structural insulated panel, and by abutting an outer-side of the inner skin to the top of one of the respective rafter spline flanges or extended rafter spline flanges, repeating the assembly with another structural insulated panel to the opposing side of the rafter spline or the extended rafter spline.

Those skilled in the art who have the benefit of this disclosure will appreciate that it may be used as the creative basis for designing devices or methods similar to those disclosed herein, or to design improvements to the invention disclosed herein; such new or improved creations should be recognized as dependent upon the invention disclosed herein to the extent of such reliance upon this disclosure.

I claim:

1. A framing assembly for constructing the frame of a building structure, the framing assembly comprising:

a. a plurality of rafter splines, each of the plurality of rafter splines comprising a support member having a lower portion and an upper portion, and a pair of flanges, with the support member having a depth or height more than a depth or height of each of the pair of flanges, and with each of the pair of flanges abutting and being affixed to the lower portion of the support member forming a lower portion of the rafter spline and with the upper portion of the support member forming the upper portion of the rafter spline;

b. a plurality of extended rafter splines, each of the plurality of extended rafter splines comprising an extended support member having a first end separated from a second end by a longitudinal body, with the extended support member further having a length longer than a length of each of the respective pair of flanges of the plurality of rafter splines, wherein the extended support member is used as a rafter tail extending beyond a roof of the building structure to form part of an eave; and c. a plurality of panels, each of the plurality of panels having two opposing sides, with at least one of the two sides having an overhang;

d. wherein at least one of the plurality of rafter splines is sandwiched between one of the two sides of two of the plurality of panels, with at least a portion of the upper portion of the rafter spline positioned underneath each panel overhang, and with the assembly of each of the plurality of rafter splines and the plurality of panels selectively forming ceiling sections or roof sections of the building structure; and e. wherein the upper portion of each rafter spline supports the overhang of two of the plurality of panels, with the lower portion of each rafter spline forming an exposed beam.

2. The framing assembly of claim 1, the support member of each of the plurality of rafter splines further comprising a top, a bottom, and a first end and a second end separated by a longitudinal body; and each of the pair of flanges of the plurality of rafter splines further comprising two opposing flange sides, a flange top, a flange bottom, and two flange ends separated by a longitudinal body, wherein a length of the rafter support member body is substantially the same length as each flange longitudinal body, with the respective ends of the rafter support member and each flange being aligned.

3. The framing assembly of claim 1, each of the plurality of rafter splines further comprising at least one surface of the lower portion of each of the plurality of rafter splines and each of the plurality of extended rafter splines further comprising at least one surface of the plurality portion of the extended rafters spline, wherein at least one surface attachment member is selectively attached to the at least one surface for the respective plurality of rafter splines and plurality of extended rafter splines for a decorative feature.

4. The framing assembly of claim 1, the assembly of the plurality of rafter splines and the plurality of panels being configured so the lower portion of each of the plurality of rafter splines faces an interior of the building structure.

5. A framing assembly for constructing the frame of a building structure having at least one exposed beam, the framing assembly comprising:

a. a plurality of rafter splines, each of the plurality of rafter splines comprising a support member having a lower portion and an upper portion, and a pair of flanges, with the support member having a depth or height more than a depth or height of each of the pair of flanges, and with each of the pair of flanges abutting and being affixed to the lower portion of the support member a lower portion of the rafter spline and with the upper portion of the support member forming the upper portion of the rafter spline;

b. a plurality of extended rafter splines, each of the plurality of extended rafter splines comprising an extended rafter support member and a pair of flanges, i. the extended rafter support member having a lower portion, an upper portion, a first end separated from a second end by a longitudinal body, with the longitudinal body of the extended rafter support member having a length longer than a length of each of a pair of flanges and extending beyond a roof of the building structure as a rafter tail to form part of an eave; and ii. the pair of rafter flanges, with the extended rafter support member having a depth or height more than a depth or height of each of the pair of flanges, with each of the pair of flanges abutting and flanking the lower portion of the extended rafter support member forming a lower portion of the extended rafter spline, and with the upper portion of the extended rafter support member forming an upper portion of the extended rafter spline;

c. a plurality of structural insulated panels, each structural insulated panel comprising an outer skin having a top, a bottom, and at least one side; a core within the structural insulated panel, the core having a top, a bottom, an end and at least one side; and an inner skin having a top, a bottom, an end, and at least one side, with the outer skin, the core, and the inner skin mounted together as a layer of the structural insulated panel further, with the structural insulated panel further comprising at least one side of each of the outer skin, the core, and the inner skin, and with at least one side of the top of the outer skin forming an overhang over at least one recessed side of the core and the inner skin;

d. wherein at least one the plurality of rafter splines or at least one of the plurality of extended rafter splines is coupled to the at least one panel side of the plurality of structural insulated panels by abutting a portion of the top of the respective rafter spline support member or extended rafter spline support member against an underside of the structural insulated panel outer skin overhang, by abutting the upper portion of a lateral side of the respective rafter spline support member or extended rafter spline support member against both the end of the recessed core and the inner skin of the structural insulated panel, and by abutting an outer-side of the inner skin to the top of one of the respective rafter spline flanges or extended rafter spline flanges, repeating the assembly with another structural insulated panel to the opposing side of the rafter spline or the extended rafter spline.

6. The framing assembly of claim 5, the framing assembly further comprising a plurality of wall splines, each of the plurality of wall splines comprising a wall support member and a pair of wall flanges, a. a wall support member having a lower portion, an upper portion, and a first end and a second end separated by a longitudinal body, with the wall support member having a depth or height more than a depth or height of each of the pair of flanges, and with each of the pair of flanges abutting and being affixed to the lower portion of the wall support member forming a lower portion of the rafter spline and with the upper portion of the support member forming the upper portion of the wall spline; and b. the pair of wall flanges, each of the pair of rafter flanges further comprising two opposing flange sides, a flange top, a flange bottom, and two flange ends separated by a longitudinal body, wherein the length of the respective wall support member body is substantially the same length as each wall flange longitudinal body, with the respective ends of the wall support member and each wall flange being aligned.

7. The framing assembly of claim 5, the framing assembly further comprising at least one surface attachment member comprising a material selected from the group consisting of a wood veneer material, stone veneer material, a brick veneer material, paint, stain, or combinations thereof, with the surface attachment member being selectively attachable to at least one side of each of the plurality of rafter splines and extended rafter splines, and attachable to at least one side of each of the plurality of rafter splines or plurality of extended rafter splines.

8. The framing assembly of claim 5, the core comprising a foam core.

9. The framing assembly of claim 5, the framing assembly further comprising at least one surface attachment member comprising a material selected from the group consisting of a wood veneer material, stone veneer material, a brick veneer material, paint, stain, or combinations thereof, with the surface attachment member being selectively attachable to at least one side of each of the plurality of wall splines, plurality of rafter splines, and plurality of extended rafter splines, with the structural insulated panels being attachable to at least one side of each of the plurality of rafter splines or plurality of extended rafter splines.

10. A framing assembly for constructing the frame of a building structure having interior exposed beams, the framing assembly comprising:

a. a plurality of rafter splines, each of the plurality of rafter splines comprising:
   i. a rafter support member having two lateral sides each having a lower portion and an upper portion, a top, a bottom, two opposing ends; and
   ii. a pair of rafter flanges, each rafter flanges having two lateral sides, a bottom, a top, and two opposing ends; with each rafter flange abutting the lower portion of each respective lateral side of the rafter support member forming a lower portion of the rafter spline, and with the upper portion of the rafter support member forming an upper portion of the rafter spline;

b. a plurality of extended rafter splines, each of the plurality of extended rafter splines comprising an extended rafter support member and a pair of extended rafter flanges,
   i. the extended rafter support member comprising two lateral sides each having a lower portion and an upper portion, a top, a bottom, a first end separated from a second end with longitudinal body having a length longer than a length of a longitudinal body of each of a pair of rafter flanges, with a portion of the extended support member extending beyond a roof forming part of an eave; and
   ii. the pair of rafter flanges, each of the rafter flanges having two lateral sides, a bottom, a top, and a first end separated from a second end by the longitudinal body; with each rafter flange abutting the lower portion of each respective lateral side of the extended rafter support member forming a lower portion of the rafter spline, and with the upper portion of the rafter support member forming an upper portion of the rafter spline;

c. a plurality of wall splines, each of the plurality of wall splines comprising:
   i. a wall support member having two lateral sides each having a lower portion and an upper portion, a top, a bottom, and two opposing ends; and
   ii. a pair of wall flanges, each wall flanges having two lateral sides, a bottom, a top, and two opposing ends; with each wall flange abutting the lower portion of each respective lateral side of the wall support member forming a lower portion of the wall spline, and with the upper portion of the wall support member forming an upper portion of the wall spline;

d. a plurality of structural insulated panels, each structural insulated panel having an outer skin, a foam core, and an inner skin, with the foam core being recessed at least from a top of the outer skin, a bottom of the outer skin, a top of the inner skin, and a bottom of the inner skin, and with the structural insulated panel further having at least panel side formed form at least one side of the outer skin forming an overhang over the foam core and the inner skin;

e. at least one surface attachment member for selectively covering at least one side of the lower portion of at least one of the plurality of wall splines, the plurality of rafter splines, or the plurality of extended rafter splines;

f. wherein one of the plurality of wall splines, one of the plurality of rafter splines, or one of the plurality of extended rafter splines is selectively coupled to at least one side of the panel side of the structural insulated panel by abutting a portion of the top of the respective spline support member against an underside of the structural insulated panel outer skin overhang, by abutting the upper portion of a lateral side of the respective spline support member against an end of the recessed foam core and an end of the inner skin of the structural insulated panel, and by abutting an outer-side of the inner skin to the top of one of the spline flanges, repeating the assembly with another structural insulated panel to the opposing side of the spline.

11. The framing assembly of claim 10, the support member of each respective plurality of wall splines, plurality of rafter splines, and plurality of extended rafter splines further comprising a depth or height more than a depth or height of each of the respective pair of flanges.

* * * * *